US009519246B2

(12) United States Patent
Shiobara

(10) Patent No.: US 9,519,246 B2
(45) Date of Patent: Dec. 13, 2016

(54) IMAGE FORMING APPARATUS HAVING IMAGE FORMING UNITS THAT VARY PRESSURE AGAINST DEVELOPER IMAGE CARRIER

(71) Applicant: Oki Data Corporation, Tokyo (JP)

(72) Inventor: Toshimasa Shiobara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/920,469

(22) Filed: Oct. 22, 2015

(65) Prior Publication Data

US 2016/0223955 A1 Aug. 4, 2016

(30) Foreign Application Priority Data

Jan. 29, 2015 (JP) ..... 2015-014949

(51) Int. Cl.
*G03G 15/16* (2006.01)

(52) U.S. Cl.
CPC ..... *G03G 15/1665* (2013.01)

(58) Field of Classification Search
CPC ..... G03G 15/1665
USPC ..... 399/66, 313, 314
See application file for complete search history.

(56) References Cited

U.S. PATENT DOCUMENTS

2007/0286628 A1* 12/2007 Kayahara ..... G03G 15/1605 399/66
2014/0328608 A1* 11/2014 Murakam ..... G03G 15/0189 399/313

FOREIGN PATENT DOCUMENTS

JP 2007033938 A * 2/2007
JP 2014-025962 A 2/2014

* cited by examiner

*Primary Examiner* — Quana M Grainger
(74) *Attorney, Agent, or Firm* — Muncy, Geissler, Olds & Lowe, P.C.

(57) ABSTRACT

An image forming apparatus includes a developer image carrier, first and second image forming units and first and second transfer parts that are arranged sandwiching the developer image carrier with the first and second image forming units. One of the first image forming unit and the first transfer part moves away from the develop image carrier so that the one of the first image forming unit and the first transfer part has two different positions (an image forming position and a non-image forming position). The image forming apparatus further comprises a pressing force variable mechanism that increases the second pressing force between the second image forming unit and the second transfer part when the one of the first image forming unit and the first transfer part moves from the image forming position to the non-image forming position.

18 Claims, 15 Drawing Sheets

*Fig. 1* *PRIOR ART*

IMAGE FORMING APPARATUS HAVING IMAGE FORMING UNITS THAT VARY PRESSURE AGAINST DEVELOPER IMAGE CARRIER

CROSS REFERENCE

The present application is related to, claims priority from and incorporates by reference Japanese Patent Application No. 2015-014949, filed on Jan. 29, 2015.

TECHNOLOGY FIELD

This invention relates to an electrophotographic image forming apparatus provided with multiple image forming units.

BACKGROUND

In general, used as an apparatus that prints a color image on a sheet as a medium is a color tandem electrophotographic device having built-in multiple image forming units storing developers (for example, toners) of different colors from one another (for example, see Patent Document 1). FIG. 1 is a cross-sectional view that schematically shows the structure of an image forming apparatus 1 as a conventional color image forming apparatus. The image forming apparatus 1 shown in FIG. 1 is an intermediate transfer type image forming apparatus that is provided with a transfer belt 2 as a developer image carrier and a secondary transfer part 3, and comprises multiple image forming units 4*a*, 4*b*, 4*c*, and 4*d* storing developers of different colors from one another. The image forming apparatus 1 has a sheet P forwarded from a sheet feeding part 5, transfers developer images formed on photosensitive drums 6*a*, 6*b*, 6*c*, and 6*d* of the image forming units 4*a*, 4*b*, 4*c*, and 4*d* to the transfer belt 2 in the primary transfer parts 7*a*, 7*b*, 7*c*, and 7*d*, and transfers the developer images carried on the transfer belt 2 to the sheet P in the secondary transfer part 3. The sheet P, to which the developer images are transferred, is carried to a fuser part 8, and the developer images are fused to the sheet P by the developer images being heated and pressurized in the fuser part 8. The sheet P, to which the developer images are fused, is ejected to the outside of the image forming apparatus 1 through an ejection part 9. The image forming apparatus 1 can selectively switch between color printing and monochrome printing by a controller (not shown). When performing monochrome printing, the image forming units used for color printing can retreat to non image forming positions separated from the transfer belt. By having the image forming units that are not used for monochrome printing retreat to the non-image forming positions, wear of the image forming units due to contacting with the transfer belt can be prevented. In FIG. 1, as an example, these image forming units 4*a*-4*c* for color print are circled with a dot-dash line and the direction towards the non image forming positions are indicated with three upward arrows.

PRIOR ART DOCUMENTS

[Patent Document 1] Japanese Unexamined Patent Application 2014-25962

However, during monochrome printing, once the image forming units used for color printing retreat to the non-image forming positions, it becomes easier for a shift in the relative speed between the developer carrier and the photosensitive drum to occur in the primary transfer part (e.g. 7*d*) in the image forming unit used for monochrome printing. There were cases that this shift in the relative speed generated slipping on the contact surfaces between the developer carrier and the photosensitive drum and generated a disturbance in the developer image transferred to the developer carrier in the primary transfer part.

Then, the objective of this invention is to offer an image forming apparatus that can realize high-quality image formation.

SUMMARY

An image forming apparatus includes a developer image carrier that rotates and carries developer images in a carrying direction, a first image forming unit and a second image forming unit that are disposed along the carrying direction of the developer image carrier, a first transfer part that is arranged sandwiching the developer image carrier with the first image forming unit to transfers a developer image formed in the first image forming unit to the developer image carrier, a first pressing force toward the developer image carrier being generated with the first image forming unit, a second transfer part that is arranged sandwiching the developer image carrier with the second image forming unit to transfers a developer image formed in the second image forming unit to the developer image carrier, a second pressing force toward the developer image carrier being generated with the second image forming unit. One of the first image forming unit and the first transfer part moves away from the develop image carrier so that the one of the first image forming unit and the first transfer part has two different positions, one position being defined as an image forming position at which the first pressure force is generated therebetween and the developer image is transferred, the other position being defined as a non-image forming position at which no first pressing force is generated therebetween and the developer image is not transferred, and the image forming apparatus further comprises a pressing force variable mechanism that increases the second pressing force between the second image forming unit and the second transfer part when the one of the first image forming unit and the first transfer part moves from the image forming position to the non-image forming position.

According to this invention, an image forming apparatus that can realize high-quality image formation can be offered.

DETAILED DESCRIPTION OF THE EMBODIMENTS

Embodiment 1

Figure 1:
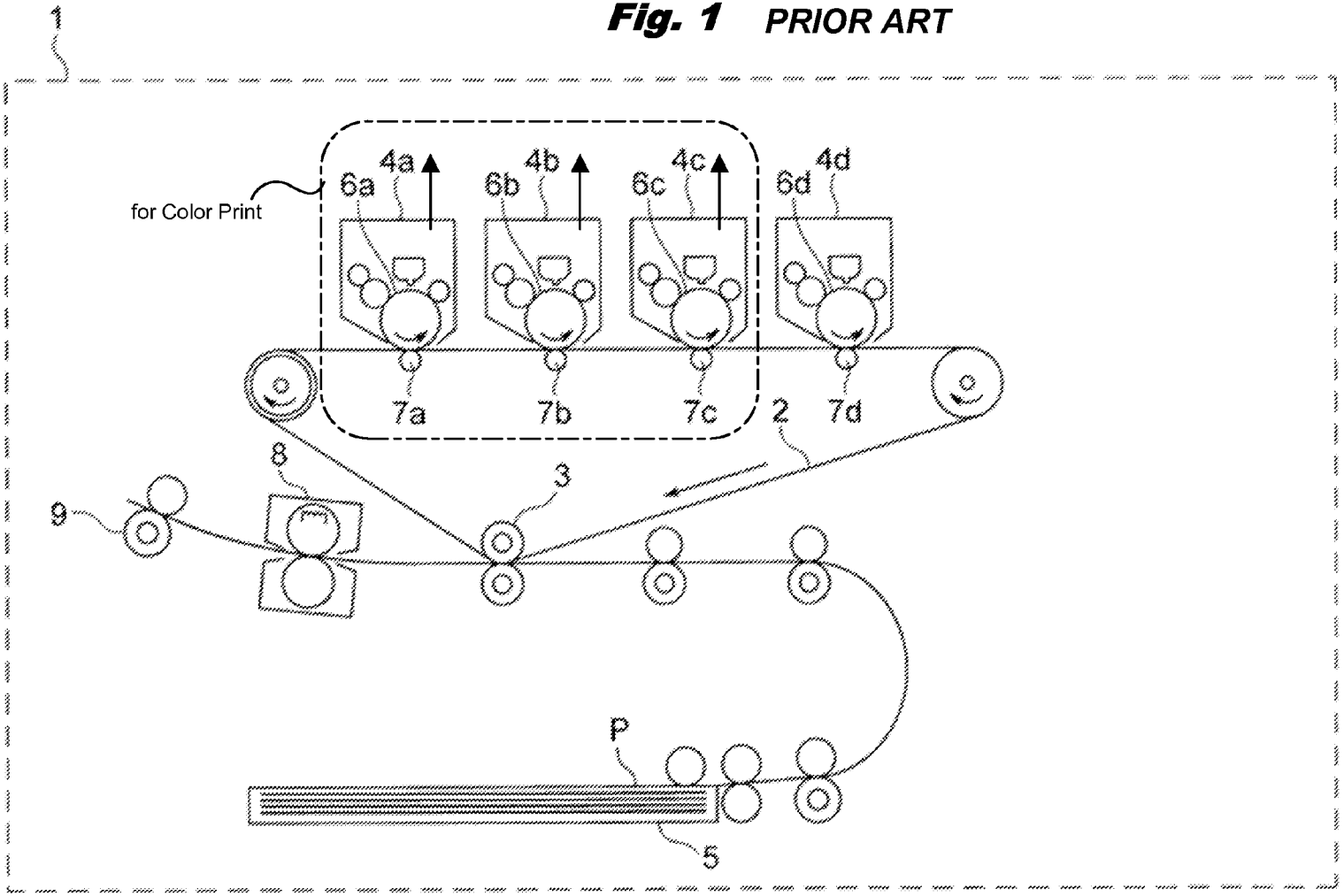
FIG. 1 is a cross-sectional view showing the structure of a conventional color image forming apparatus.
Figure 2:
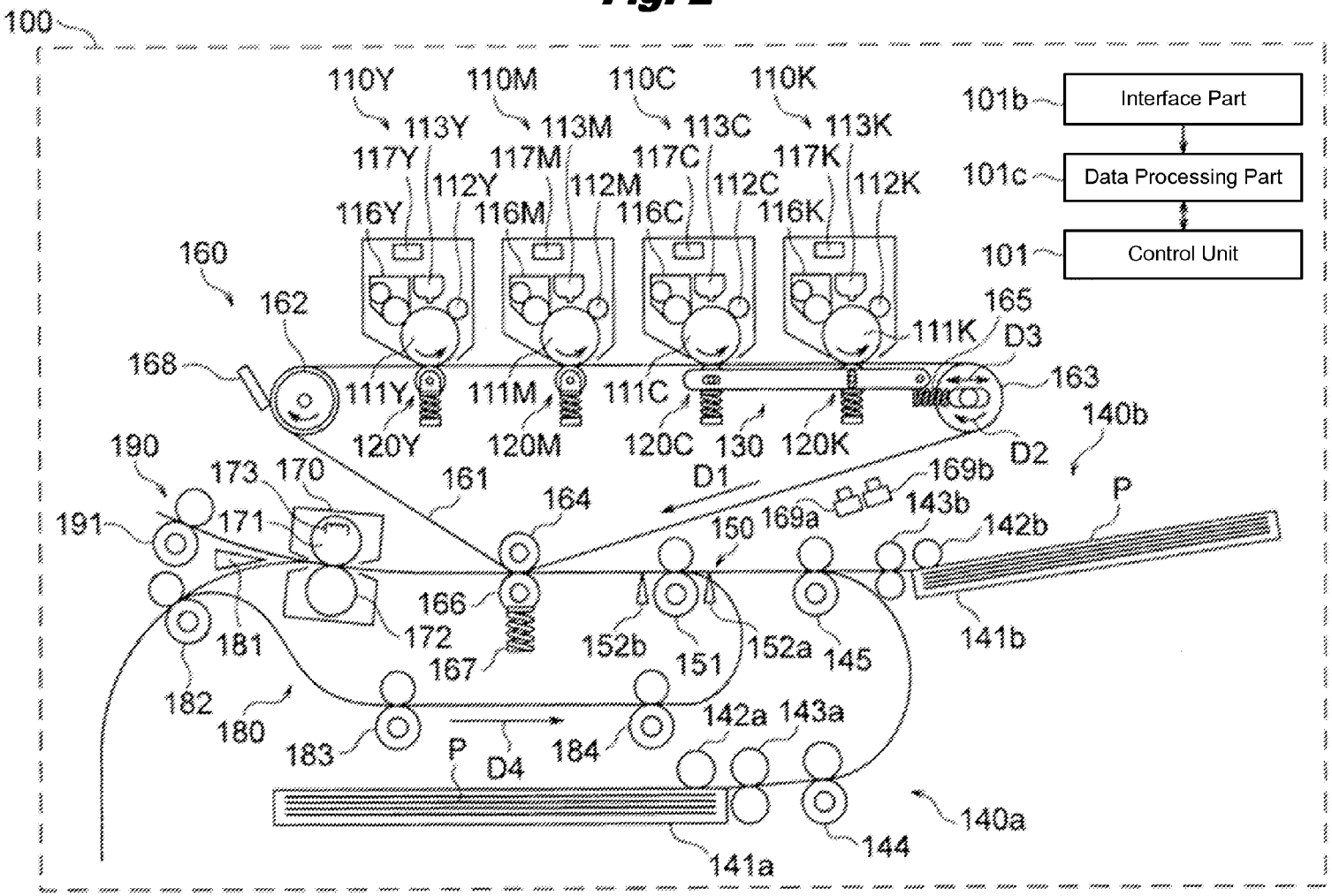
FIG. 2 is a cross-sectional view showing schematically the structure of an image forming apparatus of Embodiment 1 of this invention.
Figure 3:
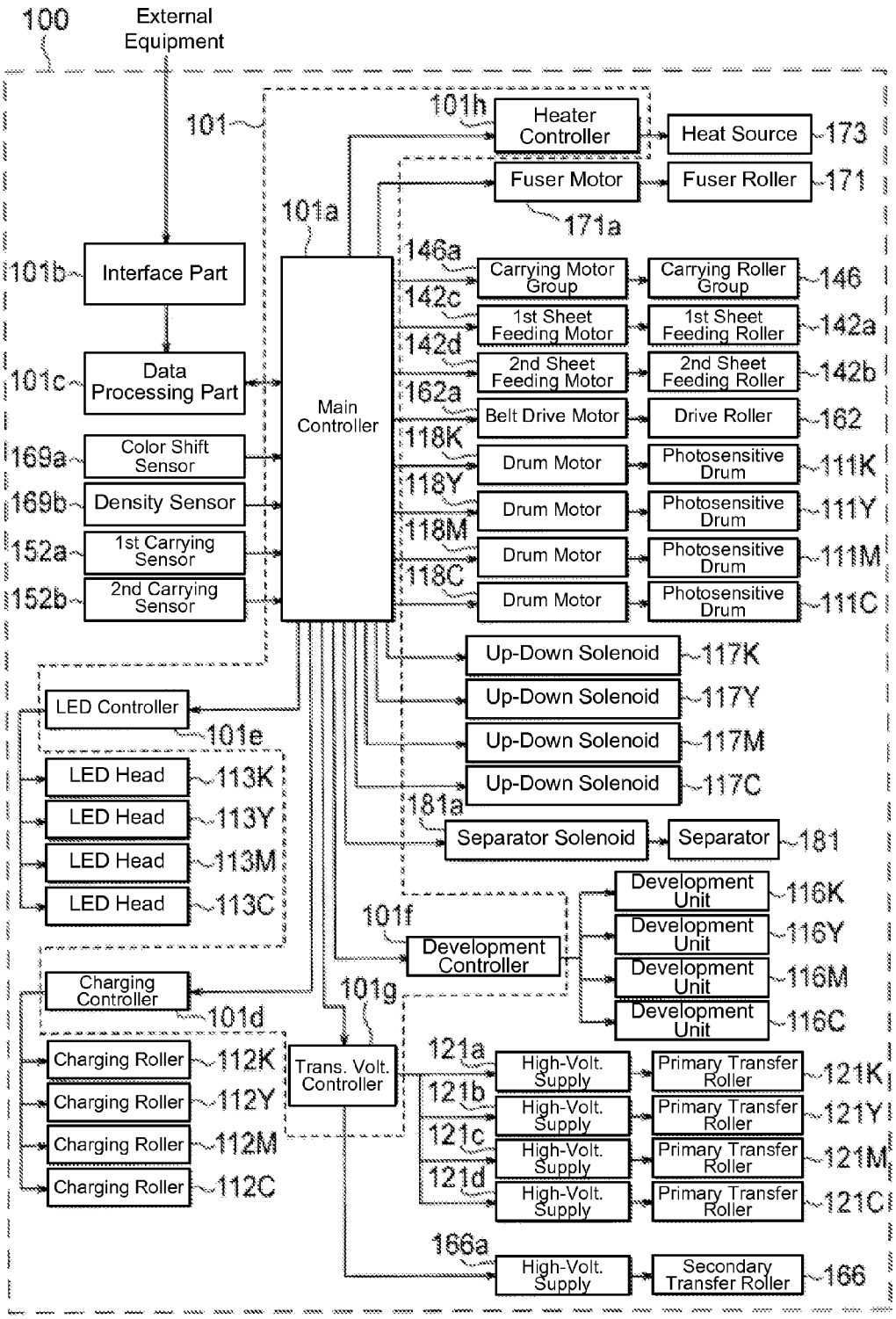
FIG. 3 is a block diagram showing schematically the configuration of the image forming apparatus shown in FIG. 2.
Figure 4:
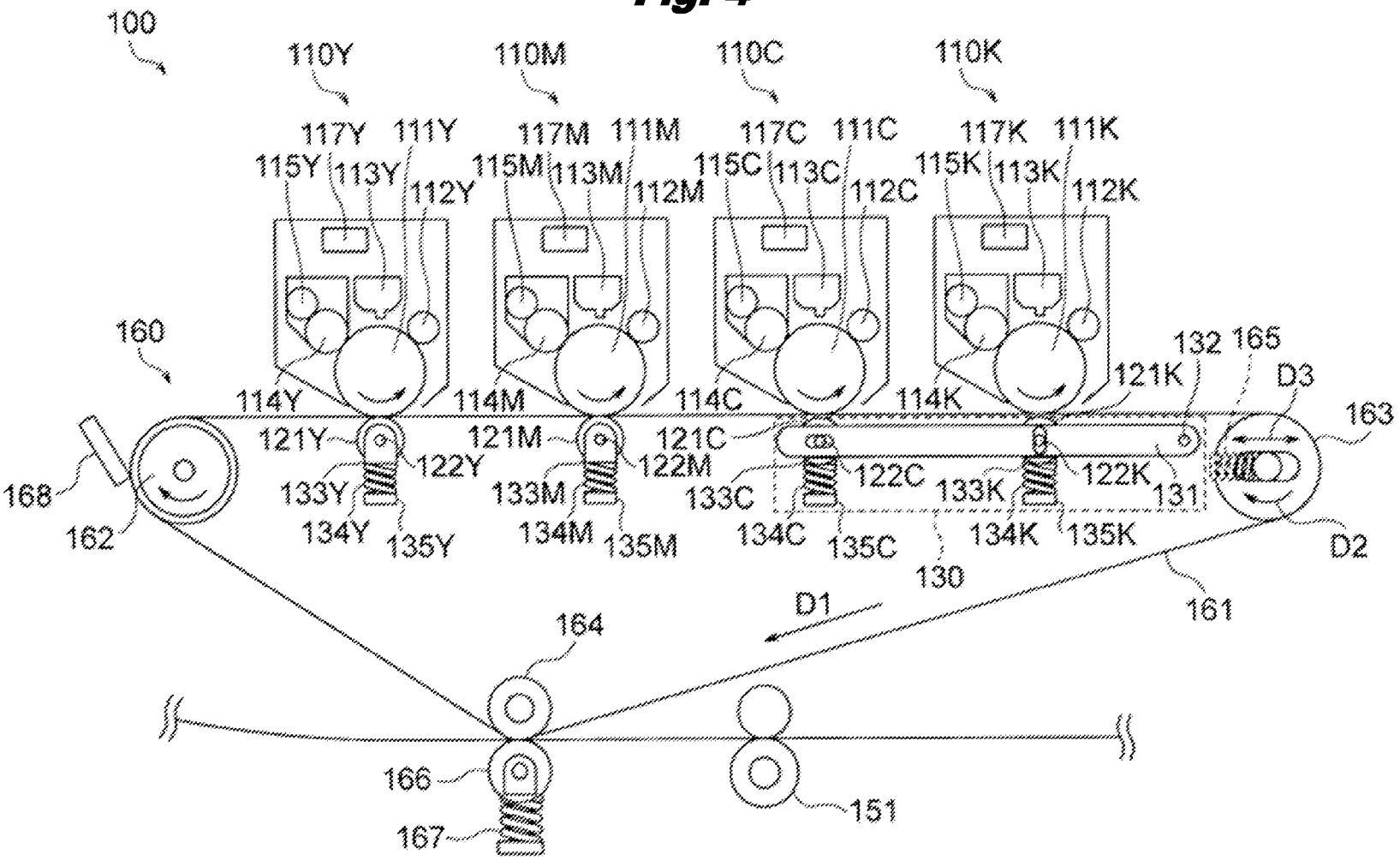
FIG. 4 is a cross-sectional view showing an enlarged view of the main part of the image forming apparatus during color printing.

FIG. 2 is a cross-sectional view showing schematically the structure of an image forming apparatus 100 of Embodiment 1 of this invention. FIG. 3 is a block diagram showing schematically the configuration of the image forming apparatus 100 shown in FIG. 2. FIG. 4 is an enlarged cross-sectional view of the main part of the image forming apparatus 100 during color printing.

The image forming apparatus 100 of Embodiment 1 is a color tandem electrophotographic device using image forming units 110Y, 110M, 110C, and 110K storing multiple developers of different colors. The image forming apparatus 100 can execute monochrome printing and color printing switched selectively.

The image forming apparatus 100 comprises a transfer belt 161 as a developer image carrier that holds and carries toner images as developer images, multiple image forming units 110Y, 110M, and 110C (first image forming units) and 110K (second image forming unit) disposed along the carrying direction (rotation direction) of the transfer belt 161, and multiple primary transfer parts 120Y, 120M, 120C, and 120K as multiple transfer parts that transfer the toner images formed respectively in the multiple image forming units 110Y, 110M, 110C, and 110K to the transfer belt 161.

Also, the image forming apparatus 100 comprises a pressing force variable mechanism 130 that changes a pressing force between the image forming unit 110K and the primary transfer part 120K through the transfer belt 161.

Also, the image forming apparatus 100 comprises an interface part 101*b*, a data processing part 101*c*, a control unit 101 that controls the whole operation of the image forming apparatus 100, a first sheet feeding part 140*a* and a second sheet feeding part 140*b* that feed a sheet P (print sheet) as a medium, a medium carrying part 150 that carries the sheet P fed from the first sheet feeding part 140*a* or the second sheet feeding part 140*b*, a transfer belt unit 160 including the transfer belt 161, a fuser unit 170 that fuses toner images transferred to the sheet P, a medium reversing part 180 for reversing the sheet P and performing rear-side printing, and an ejection part 190 that ejects the printed (image-formed) sheet P to the outside of the image forming apparatus 100.

The interface part 101*b* has a communication interface function between external equipment such as an external computer and the data processing part 101*c*. The data processing part 101*c* receives image data and the print command from the external equipment through the interface part 101*b*.

<Configuration of Image Forming Units 110Y, 110M, 110C, and 110K>

The image forming units 110Y, 110M, 110C, and 110K store yellow, magenta, cyan, and black developers (including power toners), respectively, and form images using the yellow (Y), magenta (M), cyan (C), and black (K) developers, respectively. The image forming units 110Y, 110M, 110C, and 110K of respective colors are disposed on the transfer belt unit 160 in the order of the image forming unit 110Y, the image forming unit 110M, the image forming unit 110C, and the image forming unit 110K from the upstream side in the carrying direction of the transfer belt 161 (intermediate transfer belt).

The image forming unit used for image formation during monochrome printing is regarded as the second image forming unit, and one of the image forming units other than the second image forming unit is regarded as the first image forming unit. The second image forming unit is positioned in the downstream side of the first image forming unit in the carrying direction of the transfer belt 161. In Embodiment 1, the image forming unit disposed in the most downstream-side position in the carrying direction of the transfer belt 161 is regarded as the second image forming unit.

The first image forming unit is one of the image forming units disposed in the upstream side of the second image forming unit in the carrying direction of the transfer belt 161. For example, in Embodiment 1, the first image forming unit is the image forming unit 110C, and the second image forming unit is the image forming unit 110K. However, the first image forming unit and the second image forming unit are not limited by the colors or kinds of the stored developers.

The image forming unit 110K that forms the black toner image is disposed in the most downstream-side position in the carrying direction of the transfer belt 161 among the multiple image forming units 110Y, 110M, 110C, and 110K. In other words, the image forming unit 110K is positioned between an idler roller 163 as a driven part mentioned below and the image forming unit 110C.

The image forming unit 110K comprises a photosensitive drum 111K having a toner image formed on its surface, a charging roller 112K as a charging part that uniformly charges the surface of the photosensitive drum 111K, an LED head 113K as an exposure part (LED unit) that forms an electrostatic latent image corresponding to the image data by exposing the surface of the rotating photosensitive drum 111K, a development unit 116K that supplies the black developer to the photosensitive drum 111K, and an up-down solenoid 117K that is controlled by a main controller 101*a* to move the image forming unit 110K to the image forming position or the non-image forming position.

In Embodiment 1, the "image forming position" denotes a position in contact with the developer image carrier, such as the position where an image forming unit (image forming unit 110Y, 110M, 110C, or 110K) is in contact with the transfer belt 161.

In Embodiment 1, the "non-image forming position" denotes a position separated from the developer image carrier, such as the position where an image forming unit (image forming unit 110Y, 110M, 110C, or 110K) is separated from the transfer belt 161.

The other image forming units 110Y, 110M, and 110C also have the same configuration as the image forming unit 110K. That is, the image forming unit 110C that forms a cyan toner image is disposed in a position that is next to the image forming unit 110K and in the upstream side of the image forming unit 110K in the carrying direction of the transfer belt 161. The image forming unit 110C comprises a photosensitive drum 111C having a toner image formed on its surface, a charging roller 112C as a charging part that uniformly charges the surface of the photosensitive drum 111C, an LED head 113C as an exposure part (LED unit) that forms an electrostatic latent image corresponding to the image data by exposing the surface of the rotating photosensitive drum 111C, a development unit 116C that supplies the cyan developer to the photosensitive drum 111C, and an up-down solenoid 117C that is controlled by the main controller 101*a* to move the image forming unit 110C to the image forming position or the non-image forming position.

The image forming unit 110M that forms a magenta toner image is disposed in a position that is next to the image forming unit 110C and in the upstream side of the image forming unit 110C in the carrying direction of the transfer belt 161. The image forming unit 110M comprises a photosensitive drum 111M having a toner image formed on its surface, a charging roller 112M as a charging part that uniformly charges the surface of the photosensitive drum 111M, an LED head 113M as an exposure part (LED unit) that forms an electrostatic latent image corresponding to the image data by exposing the surface of the rotating photosensitive drum 111M, a development unit 116M that supplies the magenta developer to the photosensitive drum 111M, and an up-down solenoid 117M that is controlled by the main controller 101*a* to move the image forming unit 110M to the image forming position or the non-image forming position.

The image forming unit 110Y that forms a yellow toner image is disposed in a position that is next to the image forming unit 110M and in the upstream side of the image forming unit 110M in the carrying direction of the transfer belt 161. The image forming unit 110Y comprises a photosensitive drum 111Y having a toner image formed on its surface, a charging roller 112Y as a charging part that uniformly charges the surface of the photosensitive drum 111Y, an LED head 113Y as an exposure part (LED unit) that forms an electrostatic latent image corresponding to the image data by exposing the surface of the rotating photosensitive drum 111Y, a development unit 116Y that supplies the yellow developer to the photosensitive drum 111Y, and an up-down solenoid 117Y that is controlled by the main controller 101*a* to move the image forming unit 110Y to the image forming position or the non-image forming position.

Each of the multiple photosensitive drums 111Y, 111M, 111C, and 111K comprises a metal (such as aluminum) pipe (conductive base body) and a photoconductive layer such as an organic photoconductor (OPC) formed around this metal pipe. The photosensitive drums 111Y, 111M, 111C, and 111K rotate in the direction of an arrow shown in FIG. 2 by receiving a drive force from drum motors 118Y, 118M, 118C, and 118K, respectively. The drum motors 118Y, 118M, 118C, and 118K are provided inside the image forming apparatus 100 and operate by receiving a control by the main controller 101*a* to rotate the photosensitive drums 111Y, 111M, 111C, and 111K, respectively, through a drive force transmission mechanism such as a gear.

A charging bias controlled by a charging controller 101*d* is applied to the charging rollers 112Y, 112M, 112C, and 112K. The charging rollers 112Y, 112M, 112C, and 112K uniformly charges the surfaces of the photosensitive drums 111Y, 111M, 111C, and 111K, respectively.

The multiple LED (Light Emitting Diode) heads 113Y, 113M, 113C, and 113K each comprise, for example, multiple LED elements arranged along the longitudinal direction (rotational axis direction) of the corresponding photosensitive drums 111Y, 111M, 111C, and 111K, respectively. The LED heads 113Y, 113M, 113C, and 113K are controlled by an LED controller 101*e*. The LED heads 113Y, 113M, 113C, and 113K irradiate the surfaces of the photosensitive drums 111Y, 111M, 111C, and 111K with light based on the image data to form electrostatic latent images, respectively.

The development unit 116K comprises a development roller 114K as a developer carrier and a supply roller 115K that supplies the black developer to the development roller 114K. The development unit 116C comprises a development roller 114C as a developer carrier and a supply roller 115C that supplies the cyan developer to the development roller 114C. The development unit 116M comprises a development roller 114M as a developer carrier and a supply roller 115M that supplies the magenta developer to the development roller 114M. The development unit 116Y comprises a development roller 114Y as a developer carrier and a supply roller 115Y that supplies the yellow developer to the development roller 114Y. The development units 116Y, 116M, 116C, and 116K are controlled by a development controller 101*f*. The development rollers 114Y, 114M, 114C, and 114K supply developers to the photosensitive drums 111Y, 111M, 111C, and 111K, respectively.

The up-down solenoids 170Y, 170M, 170C, and 170K are controlled by the main controller 101*a*. The up-down solenoids 170Y, 170M, 170C, and 170K selectively move the image forming units 110Y, 110M, 110C, and 110K, respectively, to either the image forming positions or the non-image forming positions based on commands from the main controller 101*a*. Therefore, each of the multiple image forming units 110Y, 110M, 110C, and 110K can move to either the image forming position or the non-image forming position.

<Configuration of Transfer Belt Unit 160>

The transfer belt unit 160 comprises a transfer belt 161 (intermediate transfer belt) as a developer image carrier, a drive roller 162 as a drive part that circulatorily rotates the transfer belt 161, an idler roller 163 as a driven part that has the transfer belt 161 stretched (stretched over with a tension applied) with appropriate tension together with the drive roller 162, and a backup roller 164 rotatably supported by the frame of the transfer belt unit 160 (belt frame) in a position opposing a secondary transfer roller 166 across the transfer belt 161.

Also, the transfer belt unit 160 comprises a spring 165 as an elastic member that biases the rotation shaft of the idler roller 163 to have the transfer belt 161 stretched (or extended) with appropriate tension, a secondary transfer roller 166 as a secondary transfer part (secondary transfer position) that transfers a toner image carried by the transfer belt 161 to the sheet P, a spring 167 as an elastic member that biases the secondary transfer roller 166 toward a backup roller 164, and a cleaning member 168 (for example, a cleaning blade) supported by the frame of the transfer belt unit 160 in a position opposing the drive roller 162 across the transfer belt 161.

Besides, the transfer belt unit 160 may be further provided with a color shift sensor 169*a* that measures the color shift of the individual color toner images carried by the transfer belt 161 and a density sensor 169*b* that detects the density of the toner images carried by the transfer belt 161.

The transfer belt unit 160 carries toner images formed in the multiple image forming units 110Y, 110M, 110C, and 110K. Specifically, the toner images formed in the multiple image forming units 110Y, 110M, 110C, and 110K are transferred to the transfer belt 161, and the transfer belt 161 carries the toner images to the secondary transfer part.

The transfer belt 161 is an endless belt made of a resin material (for example, a polyimide resin) stretched by multiple rollers (for example, the drive roller 162, the idler roller 163, and the backup roller 164) inside the transfer belt unit 160 and circulatorily rotates in the direction of an arrow D1 shown in FIG. 2.

The drive roller 162 is rotatably supported by the frame of the transfer belt unit 160 and receives a drive force from the belt drive motor 162*a*. The belt drive motor 162*a* is provided inside the image forming apparatus 100 and operates by receiving a control by the main controller 101*a* to rotate the drive roller 162 through a drive force transmission mechanism such as a gear.

The idler roller 163 is supported rotatably in the direction of an arrow D2 shown in FIG. 2 by having its rotation shaft supported by a bearing supported by the frame of the transfer belt unit 160. The bearing of the idler roller 163 rotatably support the idler roller 163 and at the same time supports the idler roller 163 movably in a direction perpendicular to the rotation shaft (the direction of an arrow D3). That is, the bearing of the idler roller 163 supports the rotation shaft of the idler roller 163 movably in a direction to either strengthen or weaken the tension of the transfer belt 161.

The secondary transfer roller 166 is configured by winding an elastic member (for example, foamed rubber) around a shaft made of metal. The secondary transfer roller 166 is biased by the spring 167 toward the backup roller 164. A transfer bias is applied to the secondary transfer roller 166 from a high-voltage supply 166*a*. Once the sheet P is carried to the secondary transfer position, the toner image carried by the transfer belt 161 is transferred to the sheet P by the voltage difference between the secondary transfer roller 166 and the backup roller 164. The high-voltage supply 166*a* is provided inside the image forming apparatus 100 and controlled by a transfer voltage controller 101*g*.

The cleaning member 168 has the tip of the cleaning member 168 contacting the surface of the transfer belt 161, is fixed to the frame of the transfer belt unit 160, and removes the developer that was not transferred by the secondary transfer roller 166 and remains on the transfer belt 161.

<Configuration of Primary Transfer Parts 120Y, 120M, 120C, and 120K>

The multiple primary transfer parts 120Y, 120M, 120C, and 120K are disposed opposing their corresponding image forming units 110Y, 110M, 110C, and 110K, respectively across the transfer belt 161. Specifically, the multiple primary transfer parts 120Y, 120M, 120C, and 120K, together with the photosensitive drums 111Y, 111M, 111C, and 111K in the corresponding image forming units 110Y, 110M, 110C, and 110K, respectively, are disposed so as to sandwich the transfer belt 161.

For example, the primary transfer part 120Y as a transfer part is disposed biased by a below-mentioned spring 134Y in a position opposing the photosensitive drum 111Y of the image forming unit 110Y across the transfer belt 161 so as to sandwich the transfer belt 161 together with the photosensitive drum 111Y. The primary transfer part 120M as a transfer part is disposed biased by a below-mentioned spring 134M in a position opposing the photosensitive drum 111M of the image forming unit 110M across the transfer belt 161 so as to sandwich the transfer belt 161 together with the photosensitive drum 111M.

The primary transfer part 120C as a transfer part (first transfer part) is disposed biased by a below-mentioned spring 134C in a position opposing the photosensitive drum 111C of the image forming unit 110C across the transfer belt 161 so as to sandwich the transfer belt 161 together with the photosensitive drum 111C. The primary transfer part 120K as a transfer part (second transfer part) is disposed biased by a below-mentioned spring 134K in a position opposing the photosensitive drum 111K of the image forming unit 110K across the transfer belt 161 so as to sandwich the transfer belt 161 together with the photosensitive drum 111K.

However, when performing monochrome printing, because the image forming units 110Y, 110M, and 110C used for color printing move to the non-image forming positions (retreat operation), the photosensitive drums 111Y, 111M, and 111C separate from the transfer belt 161.

The transfer part disposed in the most downstream side in the carrying direction of the transfer belt 161 is regarded as the second transfer part, and one of the transfer parts disposed in the upstream side of the second transfer part is regarded as the first transfer part. In Embodiment 1, for example, the first transfer part is the primary transfer part 120C, and the second transfer part is the primary transfer part 120K. Note that the first transfer part is a transfer part opposing the first image forming unit across the developer image carrier, and the second transfer unit is a transfer unit opposing the second image forming unit across the developer image carrier.

The primary transfer part 120Y transfers a toner image formed on the photosensitive drum 111Y to the transfer belt 161. The primary transfer part 120Y comprises a primary transfer roller 121Y to which a voltage (transfer bias) is applied from a high-voltage supply 121*b*, and a roller shaft 122Y that is the rotation shaft of the primary transfer roller 121Y. Besides, the high-voltage supply 121*b* is provided inside the image forming apparatus 100 and controlled by the transfer voltage controller 101*g*.

The image forming apparatus 100 comprises a holder 133Y (bearing) as a bearing part that rotatably holds both ends of the roller shaft 122Y and holds one end side of a below-mentioned spring 134Y, a spring 134Y as a bias part that is held between the holder 133Y and a below-mentioned receiving part 135Y and biases the primary transfer roller 121Y toward the photosensitive drum 111Y of the image forming unit 110Y through the holder 133Y, and a receiving part 135Y that is fixed to the frame of the transfer belt unit 160 and holds the other end side (the opposite side of the holder 133Y side) of the spring 134Y. However, the other end side of the spring 134Y may be directly fixed to the frame of the transfer belt unit 160 or the chassis of the image forming apparatus 100.

The holder 133Y is guided by the frame of the transfer belt unit 160 movably in a direction perpendicular to the roller shaft 122Y (the direction toward the photosensitive drum 111Y and the direction away from the photosensitive drum 111Y). The holder 133Y rotatably supports both ends of the roller shaft 122Y and supports the primary transfer part 120Y movably in a direction perpendicular to the roller shaft 122Y (the direction toward the photosensitive drum 111Y and the direction away from the photosensitive drum 111Y).

The primary transfer part 120M transfers a toner image formed on the photosensitive drum 111M to the transfer belt 161. The primary transfer part 120M comprises a primary transfer roller 121M to which a voltage (transfer bias) is applied from a high-voltage supply 121*c*, and a roller shaft 122M that is the rotation shaft of the primary transfer roller 121M. Besides, the high-voltage supply 121*c* is provided inside the image forming apparatus 100 and controlled by the transfer voltage controller 101*g*.

The image forming apparatus 100 comprises a holder 133M (bearing) as a bearing part that rotatably holds both ends of the roller shaft 122M and holds one end side of a below-mentioned spring 134M, a spring 134M as a bias part that is held between the holder 133M and a below-mentioned receiving part 135M and biases the primary transfer roller 121M toward the photosensitive drum 111M of the image forming unit 110M through the holder 133M, and a receiving part 135M that is fixed to the frame of the transfer belt unit 160 and holds the other end side (the opposite side of the holder 133M side) of the spring 134M. However, the other end side of the spring 134M may be directly fixed to the frame of the transfer belt unit 160 or the chassis of the image forming apparatus 100.

The holder 133M is guided by the frame of the transfer belt unit 160 movably in a direction perpendicular to the roller shaft 122M (the direction toward the photosensitive drum 111M and the direction away from the photosensitive drum 111M). The holder 133M rotatably supports both ends of the roller shaft 122M and at the same time supports the primary transfer part 120M movably in a direction perpendicular to the roller shaft 122M (the direction toward the photosensitive drum 111M and the direction away from the photosensitive drum 111M).

The primary transfer part 120C transfers a toner image formed on the photosensitive drum 111C to the transfer belt 161. The primary transfer part 120C comprises a primary transfer roller 121C to which a voltage (transfer bias) is applied from a high-voltage supply 121*d*, and a roller shaft 122C that is the rotation shaft of the primary transfer roller 121C. Both ends of the roller shaft 122C are rotatably held by a below-mentioned holder 133C of the pressing force variable mechanism 130. Besides, the high-voltage supply 121*d* is provided inside the image forming apparatus 100 and controlled by the transfer voltage controller 101*g*.

The primary transfer part 120K transfers a toner image formed on the photosensitive drum 111K to the transfer belt 161. The primary transfer part 120K comprises a primary transfer roller 121K to which a voltage (transfer bias) is applied from a high-voltage supply 121*a*, and a roller shaft 122K that is the rotation shaft of the primary transfer roller 121K. Both ends of the roller shaft 122K are rotatably held by a below-mentioned holder 133K of the pressing force variable mechanism 130. Besides, the high-voltage supply 121*a* is provided inside the image forming apparatus 100 and controlled by the transfer voltage controller 101*g*.

<Configuration of Pressing Force Variable Mechanism>

Figure 5:
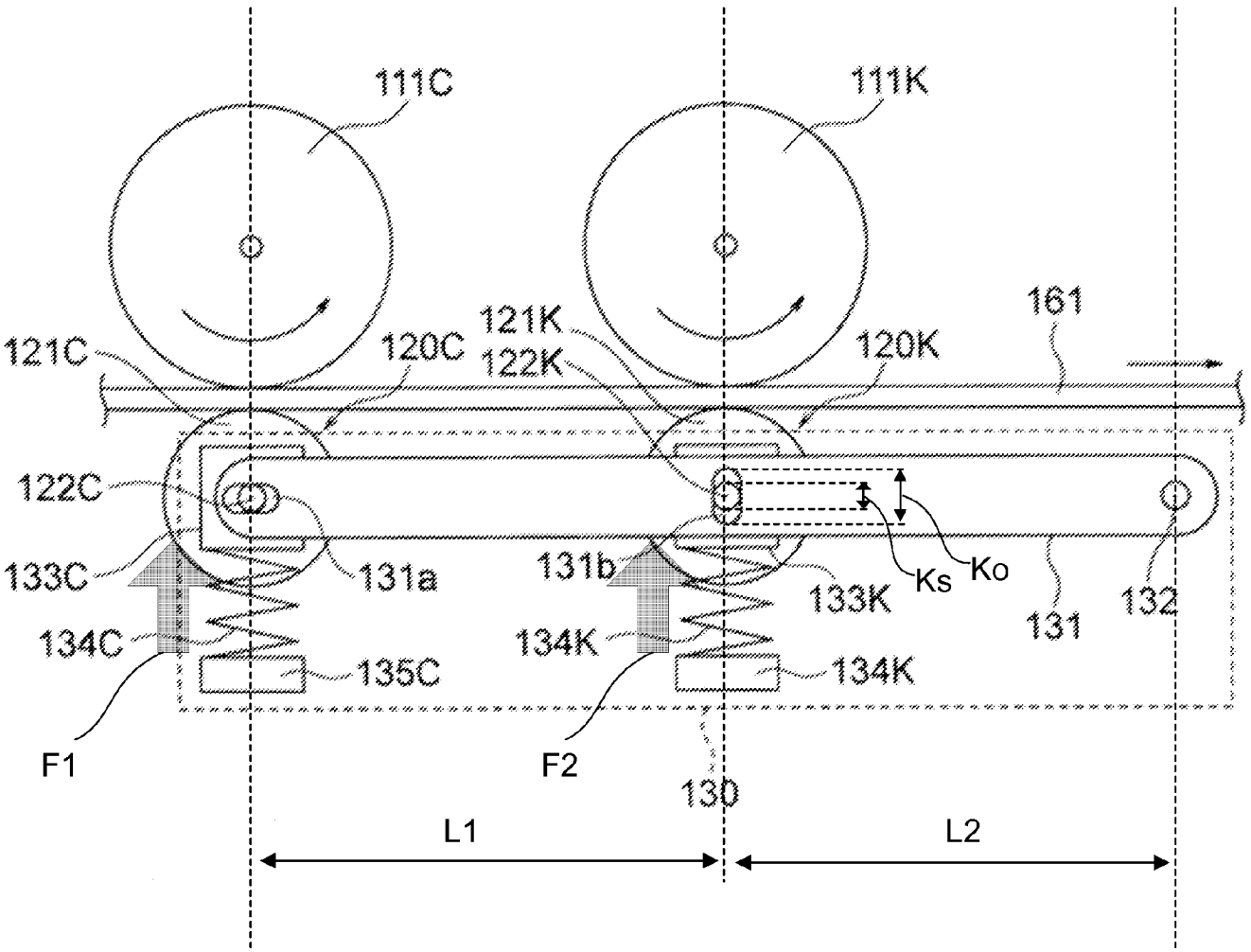
FIG. 5 is an enlarged side view showing the structure of a pressing force variable mechanism built in the image forming apparatus.
Figure 6:
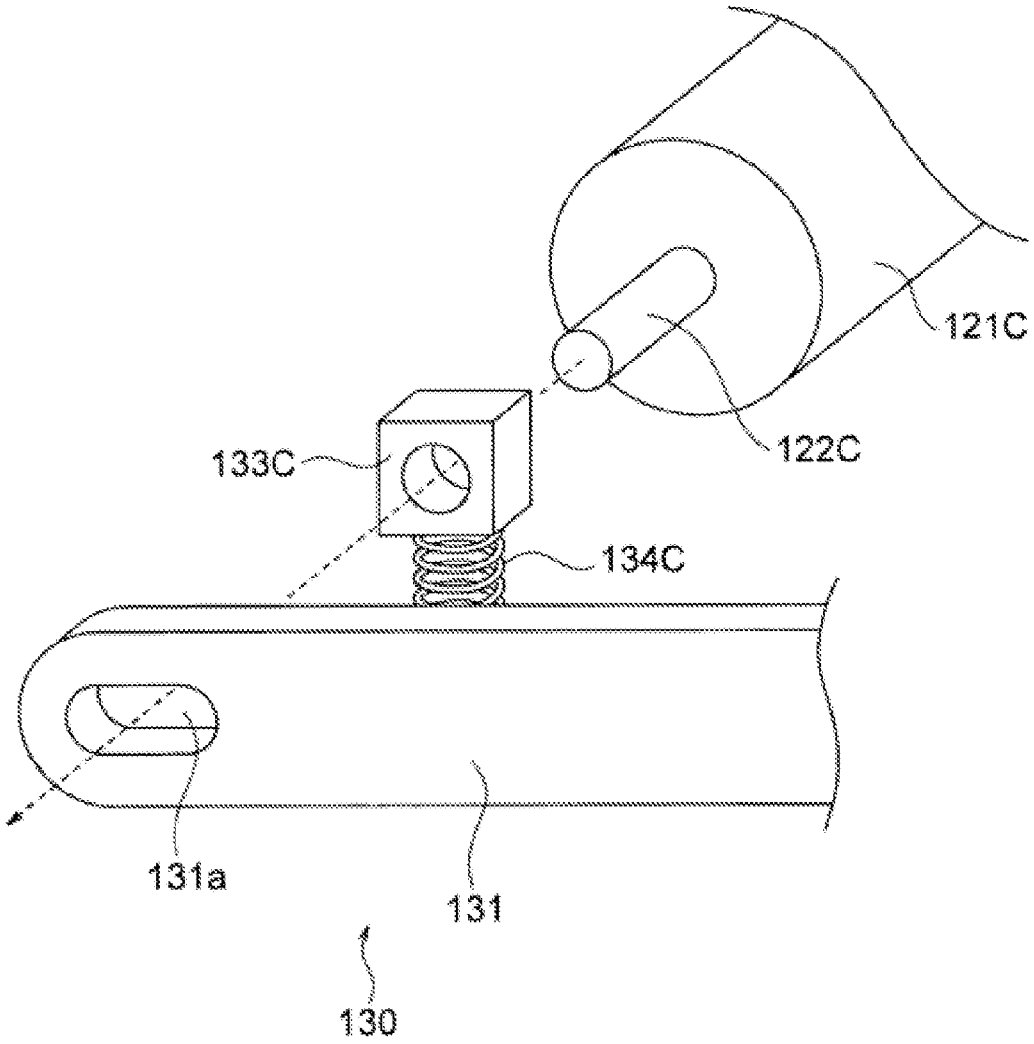
FIG. 6 is an exploded perspective view showing the assembly structure of a pressing force variable mechanism and a primary transfer part.
Figure 7:
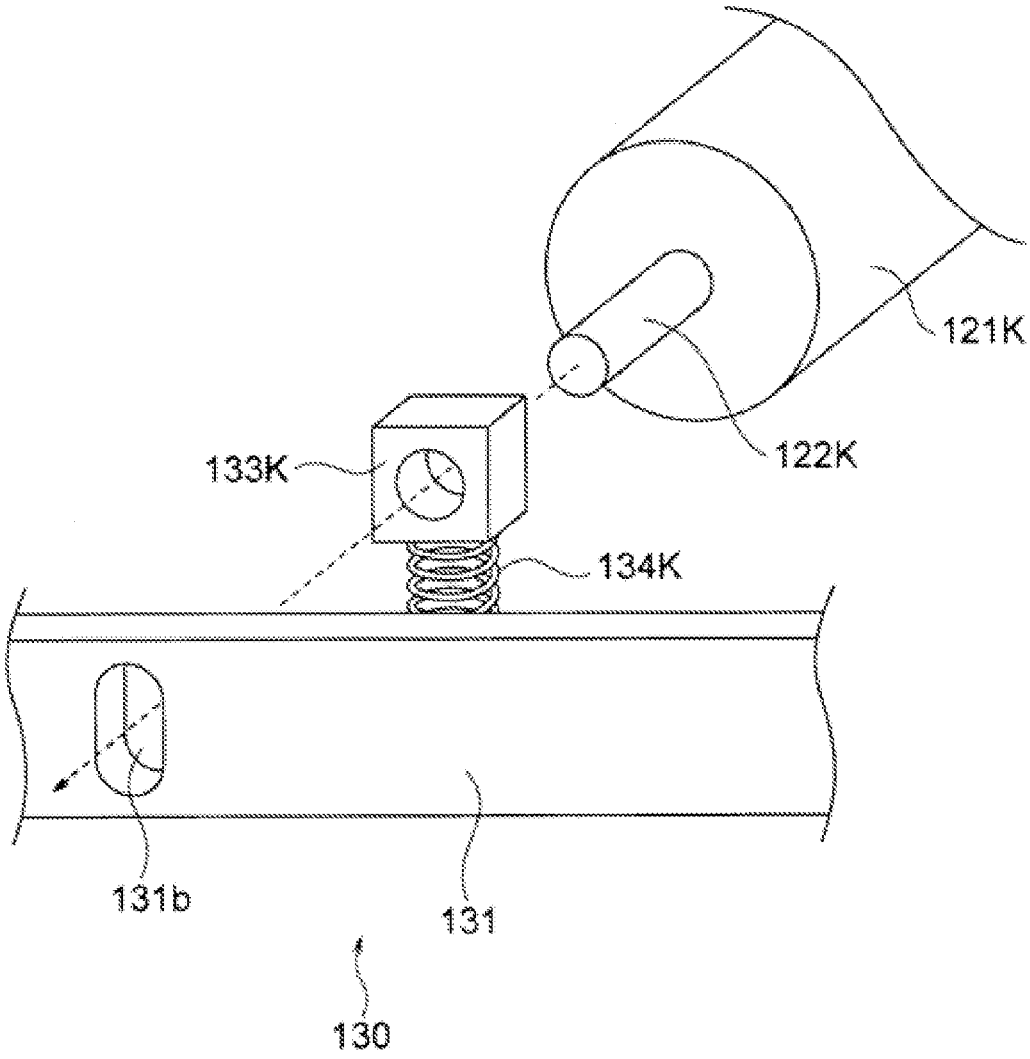
FIG. 7 is an exploded perspective view showing the assembly structure of a pressing force variable mechanism and a primary transfer part.

FIG. 5 is an enlarged side view showing the configuration of the pressing force variable mechanism built in the image forming apparatus 100. FIG. 6 is an exploded perspective view showing the assembly structure of the pressing force variable mechanism 130 and the primary transfer part 120C. FIG. 7 is an exploded perspective view showing the assembly structure of the pressing force variable mechanism 130 and the primary transfer part 120K.

The pressing force variable mechanism 130 comprises a link 131 (tension bar) as a link part that links the first transfer part (for example, the primary transfer part 120C) and the second transfer part (for example, the primary transfer part 120K), a holder 133C (bearing) that rotatably supports both ends of the roller shaft 122C (the first roller shaft), a holder 133K (bearing) that rotatably supports both ends of the roller shaft 122K (the second roller shaft), a spring 134C as the first bias part that biases the primary transfer part 120C toward the image forming unit 110C, and a spring 134K as the second bias part that biases the primary transfer part 120K toward the image forming unit 110K.

The link 131 can be configured of a plate-shape resin or metal having its length in the longitudinal direction (the direction parallel to the array direction of the multiple primary transfer parts 120C and 120K).

Also, the pressing force variable mechanism 130 comprises a receiving part 135C that is fixed to the frame of the transfer belt unit 160 and holds one end side (the opposite side of the holder 133C side) of the spring 134C, and a receiving part 135K that is fixed to the frame of the transfer belt unit 160 and holds one end side (the opposite side of the holder 133K side) of the spring 134K. However, the other end side of the spring 134C and one end side of the spring 134Y may be directly fixed to the frame of the transfer belt unit 160 or the chassis of the image forming apparatus 100.

The link 131 has a first hole part 131*a* and a second hole part 131*b* formed. By the first hole part 131*a* engaging with one-side end of the roller shaft 122C and the second hole part 131*b* engaging with one-side end of the roller shaft 122K, the primary transfer part 120C and the primary transfer part 120K are linked. The one-side end of the roller shaft 122C can freely rotate in the first hole part 131*a*, and the one-side end of the roller shaft 122K can freely rotate in the second hole part 131*b*.

The pressing force variable mechanism 130 comprises a fulcrum part 132 that rotatably supports the link 131 at a longitudinal-direction end of the link 131. Therefore, the link 131 can freely rotate having the fulcrum part 132 as its fulcrum (rotation center). The fulcrum part 132 only needs to be a structure that becomes the rotation center when the link 131 operates in a freely rotatable manner. For example, a hole formed at a longitudinal-direction end of the link 131 can be regarded as the fulcrum part 132 and rotatably engaged with a protrusion formed on the frame of the transfer belt unit 160. Also, the link 131 may be rotatably configured by forming a protrusion on the fulcrum part 132 and forming a hole that engages with this protrusion on the frame of the transfer belt unit 160.

As shown in FIG. 5, in a state that the image forming unit 110C is positioned in the image forming position, the first hole part 131*a* has a play (or space) between the roller shaft 122C and the inner wall of the first hole part 131*a*. Therefore, the roller shaft 122C is loosely fit in the first hole part 131*a*. The first hole part 131*a* should desirably be a hole having a length along the longitudinal direction of the link 131 in a state that the image forming unit 110C is in the image forming position.

As shown in FIG. 5, in a state that the image forming unit 110K is positioned in the image forming position, the second hole part 131*b* has a play (or space) between the roller shaft 122K and the inner wall of the second hole part 131*b*. Therefore, the roller shaft 122K is loosely fit in the second hole part 131*b*. The second hole part 131*b* should desirably be a hole having a length along the direction that the spring 134K biases the holder 133K (the movable direction of the roller shaft 122K) in a state that the image forming unit 110K is in the image forming position.

(1) When an outer diameter of the roller shaft 122K is denoted with Ks, an inner length of the second hole part 131*b* with respect to a moving direction of the roller shaft 122K is denoted with Ko, it may be preferred for proportion Ks/Ko to be ranged within 30% to 80%. That is because the certain play maintains within the hole part 131*b* also the roller shaft 122K can contact one of the edges of the hole part 122K immedeately when the shaft moves.

(2) When the bias forces respectively generated by springs 134C and 134K are denoted with F1 and F2, proportion F1/F2 is a design matter but the proportion may be substantially 1.

(3) When a distance between the roller shafts 122C and 122K is denoted with L1, another distance between the roller shaft 122K and the fulcrum part 132 is with L2, proportion L1/L2 as well is a design matter. In the light of effectively using the leverage of the link 131, the proportion may be 1 or greater than 1.

When performing color printing, in a state that the image forming units 110C and 110K are in contact with the transfer belt 161 (that is, the photosensitive drums 111C and 111K are in contact with the transfer belt 161), because the bias force of the spring 134C of the primary transfer part 120C is not transmitted to the primary transfer part 120K through the pressing force variable mechanism 130, the pressing force between the primary transfer part 120K and the photosensitive drum 111K is not influenced by the pressing force variable mechanism 130. Therefore, when performing color printing, in a state that the image forming units 110C and 110K are in contact with the transfer belt 161, the pressing force between the primary transfer part 120C and the photosensitive drum 111C through the transfer belt 161 is determined by the bias force of the spring 134C. In the same manner, the pressing force between the primary transfer part 120K and the photosensitive drum 111K through the transfer belt 161 when performing color printing is determined by the bias force of the spring 134K.

Although the distance between the fulcrum part 132 and the roller shaft 122C changes if the primary transfer part 120C moves interlocked with the movement of the image forming unit 110C, because a play is formed between the roller shaft 122C and the inner wall of the first hole part 131*a*, the change in distance between the fulcrum part 132 and the roller shaft 122C can be absorbed. Therefore, the primary transfer part 120C can move interlocked with the movement of the image forming unit 110C in the direction biased by the spring 134C. Therefore, the play formed between the roller shaft 122C and the inner wall of the first hole part 131*a* should desirably be formed in the longitudinal direction of the link 131.

The holder 133C is guided by the frame of the transfer belt unit 160 movably in a direction perpendicular to the roller shaft 122C (the direction toward the photosensitive drum 111C and the direction away from the photosensitive drum 111C). The holder 133C rotatably supports both ends of the roller shaft 122C and supports the primary transfer part 120C movably in a direction perpendicular to the roller shaft 122C (the direction toward the photosensitive drum 111C and the direction away from the photosensitive drum 111C). Therefore, the primary transfer part 120C can move to either the image forming position or the non-image forming position.

The holder 133K is guided by the frame of the transfer belt unit 160 movably in a direction perpendicular to the roller shaft 122K (the direction toward the photosensitive drum 111K and the direction away from the photosensitive drum 111K). The holder 133K rotatably supports both ends of the roller shaft 122K and supports the primary transfer part 120K movably in a direction perpendicular to the roller shaft 122K (the direction toward the photosensitive drum 111K and the direction away from the photosensitive drum 111K). Therefore, the primary transfer part 120K can move to either the image forming position or the non-image forming position. However, the primary transfer part 120K is usually positioned in the image forming position.

The spring 134C is held between the holder 133C and the receiving part 135C and biases the primary transfer part 120C toward the photosensitive drum 111C through the holder 133C. The spring 134K is held between the holder 133K and the receiving part 135K and biases the primary transfer part 120K toward the photosensitive drum 111K through the holder 133K.

Because the link 131 links the primary transfer part 120C and the primary transfer part 120K, a bias force in the same direction as the bias force by the spring 134C can be applied to the primary transfer part 120K through the link 131. The bias force applied by the link 131 is defined as an additional bias force.

The pressing force variable mechanism 130 is not limited to a configuration of being provided on one-side end of the roller shafts (for example, one-side end of each of the roller shaft 122C and the roller shaft 122K) but can be provided on both-side ends of the roller shafts (for example, both-side ends of each of the roller shaft 122C and the roller shaft 122K). By providing the pressing force variable mechanism 130 on both-side ends of the roller shafts, the pressing force between the primary transfer part 120K and the photosensitive drum 111K through the transfer belt 161 can be made uniform over the longitudinal direction (that is, the axial direction of the roller shaft 122K) of the primary transfer part 120K and the photosensitive drum 111K.

<Configuration of First Sheet Feeding Part 140*a*>

The first sheet feeding part 140*a* comprises a first sheet cassette 141*a* that stores sheets P, a first sheet feeding roller 142*a* that forwards the sheets P from the first sheet cassette 141*a*, a first separation roller 143*a* as a separation part that separates the sheets P into single pieces and forwards one if multiple pieces are forwarded in a stacked state by the first sheet feeding roller 142*a*, a first registration roller pair 144 that corrects the skew of and carries the sheet P forwarded from the first separation roller 143*a*, and a second registration roller pair 145 that carries the sheet P carried by the first registration roller pair 144 to the secondary transfer position where the secondary transfer roller 166 is disposed.

The first sheet feeding roller 142*a* receives a drive force from a first sheet feeding motor 142*c*. The first sheet feeding motor 142*c* is provided inside the image forming apparatus 100 and operates by receiving a control by the main controller 101*a* to rotate the first sheet feeding roller 142*a* through a drive force transmission mechanism such as a gear. Each of the other rollers than the first sheet feeding roller 142*a* included in the first sheet feeding part 140*a* is a part of a carrying roller group 146 shown in FIG. 3 and receives a drive force from a carrying motor group 146*a*.

<Configuration of the Second Sheet Feeding Part 140*b*>

The second sheet feeding part 140*b* is a preferable sheet feeding part when thick sheets of paper or special media other than normal sheets of paper are stored as the sheets P and used for printing. However, normal sheets of paper can also be stored as the sheets P in the second sheet feeding part 140*b* to be used for printing.

The second sheet feeding part 140*b* comprises a second sheet cassette 141*b* that stores the sheets P, a second sheet feeding roller 142*b* that forwards the sheets P from the second sheet cassette 141*b*, and a second separation roller 143*b* as a separation part that separates the sheets P into single pieces and forwards one if multiple pieces are forwarded in a stacked state by the second sheet feeding roller 142*b*. The sheet P forwarded from the second separation roller 143*b* has its skew corrected and carried toward the secondary transfer part by the second registration roller pair 145.

The second sheet feeding roller 142*b* receives a drive force from a second sheet feeding motor 142*d*. The second sheet feeding motor 142*d* is provided inside the image forming apparatus 100 and operates by receiving a control by the main controller 101*a* to rotate the second sheet feeding roller 142*b* through a drive force transmission mechanism such as a gear. Each of the other rollers than the second sheet feeding roller 142*b* included in the second sheet feeding part 140*b* is a part of the carrying roller group 146 shown in FIG. 3 and receives a drive force from the carrying motor group 146*a*.

<Configuration of Medium Carrying Part 150>

The medium carrying part 150 comprises a first carrying roller pair 151 that carries the sheet P carried by the second registration roller pair 145 to the secondary transfer position where the secondary transfer roller 166 is disposed, and a first carrying sensor 152*a* and a second carrying sensor 152*b* that detect the sheet P passing on the sheet carrying path. The second carrying sensor 152*b* is disposed in the downstream side of the first carrying sensor 152*a* in the carrying direction of the sheet P.

<Configuration of Fuser Unit 170>

The fuser unit 170 is disposed in the downstream side of the secondary transfer roller 166 in the carrying direction of the sheet P. It comprises a fuser roller 171 that fuses toner images on the sheet P by heating and pressurizing the toner images transferred onto the sheet P, and a backup roller 172 that pressurizes the fuser roller 171 using an elastic member such as a spring. Inside the fuser roller 171, a heat source 173 is disposed. The fuser roller 171 receives a drive force from the fuser motor 171*a*. The fuser motor 171*a* is provided inside the image forming apparatus 100 and operates by receiving a control by the main controller 101*a* to rotate the fuser roller 171 through a drive force transmission mechanism such as a gear.

<Configuration of Medium Reversing Part 180>

The medium reversing part 180 comprises a separator 181 that switches the direction to carry the sheet P, a separator solenoid 181*a*, a switchback roller pair 182, a carrying roller pair 183 (second carrying roller pair), and a carrying roller pair 184 (third carrying roller pair). When performing the rear-side printing (both-sides printing) of the sheet P, the medium reversing part 180 reverses the sheet P by switching it back by the switchback roller pair 182. The separator solenoid 181*a* operates by receiving a control by the main controller 101*a* and can selectively switch between sending the sheet P to the ejection part 190 and sending it to the medium reversing part 180. The carrying roller pairs 183 and 184 carry the sheet P switched back by the switchback roller pair 182 in the direction of an arrow D4 shown in FIG. 2 and carry it to the secondary transfer position. The carrying roller pairs 183 and 184 are a part of the carrying roller group 146 shown in FIG. 3 and receive drive forces from the carrying motor group 146*a*.

<Configuration of Ejection Part 190>

The ejection part 190 comprises an ejection roller pair 191 that ejects the sheet P, to which toner images are fused, to the outside of the image forming apparatus 100. The ejection roller pair 191 is a part of the carrying roller group 146 shown in FIG. 3 and receives a drive force from the carrying motor group 146*a*.

<Configuration of Control Unit 101>

The control unit 101 comprises the main controller 101*a*, the interface part 101*b*, the data processing part 101*c*, the charging controller 101*d*, the LED controller 101*e*, the development controller 101*f*, the transfer voltage controller 101*g*, and a heater controller 101*h*.

The interface part 101*b* has a communication interface function between external equipment such as an external computer and the data processing part 101*c*. The data processing part 101*c* receives image data and the print command through the interface part 101*b*.

The main controller 101*a* issues instructions to the individual controllers based on the print command (including image data) received from external equipment through the data processing part 101*c*. Based on the instructions from the main controller 101*a*, the charging controller 101*d* controls the charging biases applied to the charging rollers 112K, 112Y, 112M, and 112C. Based on the instructions (for example, image data) from the main controller 101*a*, the LED controller 101*e* controls light radiated from the LED heads 113K, 113Y, 113M, and 113C. Based on the instructions from the main controller 101*a*, the development controller 101*f* controls the development rollers 114K, 114Y, 114M, and 114C and the supply rollers 115K, 115Y, 115M, and 115C in the development units 116K, 116Y, 116M, and 116C. Based on the instructions from the main controller 101*a*, the transfer voltage controller 101*g* controls the transfer biases (primary transfer biases) applied to the primary transfer rollers 121K, 121Y, 121M, and 121C by the high-voltage supplies 121*a*, 121*b*, 121*c*, and 121*d*, respectively. Also, Based on the instructions from the main controller 101*a*, the transfer voltage controller 101*g* controls the transfer bias (secondary transfer bias) applied to the secondary transfer roller 166 by the high-voltage supply 166*a*. Based on the instructions from the main controller 101*a*, the heater controller 101*h* controls heating by the heat source 173.

<Operations of Image Forming Apparatus 100>

In the image forming apparatus 100 that adopted an intermediate transfer system, image formation in each of the multiple image forming units 110Y, 110M, 110C, and 110K is executed considering the timing that the sheet P forwarded from the sheet feeding part (for example, the first sheet feeding part 140*a*) reaches the secondary transfer position.

For example, when performing color printing, if the toner image carrying distance from the primary transfer position where the primary transfer part 120Y of the image forming unit 110Y positioned in the most upstream side among the multiple image forming units 110Y, 110M, 110C, and 110K to the secondary transfer position is longer than the carrying distance of the sheet P from the first sheet feeding roller 142*a* to the secondary transfer position, image formation (image forming process) is started in the image forming unit 110Y at an earlier timing than the timing that the sheet P is forwarded from the first sheet feeding roller 142*a*.

Once the print command (including image data) is input to the image forming apparatus 100 through the interface part 101*b* from external equipment such as an external computer, the image data input from the outside are processed by the data processing part 101*c*, and the print command is sent to the main controller 101*a*. Based on the print command, the main controller 101*a* sends control signals to the drum motors 118K, 118Y, 118M, and 118C, and the belt drive motor 162*a*, and each of the multiple drum motors 118K, 118Y, 118M, and 118C and the belt drive motor 162*a* rotate to start image formation in each of the multiple image forming units 110K, 110Y, 110M, and 110C.

Once the image data based on the print command are sent from the main controller 101*a* to the LED controller 101*e*, the LED controller 101*e* sends control signals corresponding to the image data to the LED heads 113Y, 113M, 113C, and 113K.

To the charging rollers 112Y, 112M, 112C, and 112K, charging biases controlled by the charging controller 101*d* are applied. The charging rollers 112Y, 112M, 112C, and 112K uniformly charge the surfaces of the photosensitive drums 111Y, 111M, 111C, and 111K, respectively.

By the LED head 113Y of the image forming unit 110Y positioned in the most upstream side in the carrying direction of the transfer belt 161 among the multiple image forming units 110Y, 110M, 110C, and 110K, an electrostatic latent image corresponding to the image data is formed on the surface of the uniformly-charged photosensitive drum 111Y.

After image formation is started in the image forming unit 110Y, by the LED head 113M in the image forming unit 110M, an electrostatic latent image corresponding to the image data is formed on the surface of the photosensitive drum 111M. In the same manner, in the image forming units 110C and 110K, electrostatic latent images corresponding to the image data are formed on the surfaces of the photosensitive drums 111C and 111K.

The development units 116Y, 116M, 116C, and 116K supply developers to the photosensitive drums 111Y, 111M, 111C, and 111K, respectively, where electrostatic latent images are formed, to form toner images based on the electrostatic latent images.

The individual toner images formed in the image forming units 110Y, 110M, 110C, and 110K are sequentially transferred by the primary transfer parts 120Y, 120M, 120C, and 120K starting with the yellow toner image so as to overlap with one another on the surface of the transfer belt 161.

When the main controller 101*a* has received the print command to print onto the sheets P stored in the first sheet cassette 141*a*, the main controller 101*a* sends control signals to the individual controllers. Image formation is started in the image forming units 110Y, 110M, 110C, and 110K, and after specified time passed, the first sheet feeding motor 142*c* rotates, the first sheet feeding roller 142*a* forwards the sheets P, the sheets P are separated into single pieces by the first separation roller 143*a*, and each sheet P is carried toward the first registration roller pair 144. Once the sheet P has been carried to the first registration roller pair 144, the sheet P is aligned by the first registration roller pair 144, the sheet P is further carried by the second registration roller pair 145, and the tip of the sheet P reaches the position where the first carrying sensor 152*a* is disposed.

When the main controller 101*a* has received the print command to print onto the sheets P stored in the second sheet cassette 141*b*, the main controller 101*a* sends control signals to the individual controllers. Image formation is started in the image forming units 110Y, 110M, 110C, and 110K, and after specified time passed, the second sheet feeding motor 142*d* rotates, the second sheet feeding roller 142*b* forwards the sheets P, the sheets P are separated into single pieces by the second separation roller 143*b*, and each sheet P is carried toward the second registration roller pair 145. Once the sheet P has been carried to the second registration roller pair 145, the sheet P is aligned by the second registration roller pair 145, the sheet P is further carried by the second registration roller pair 145, and the tip of the sheet P reaches the position where the first carrying sensor 152*a* is disposed.

Once the first carrying sensor 152*a* has detected that the tip of the sheet P has reached the first carrying sensor 152*a*, the timing that the sheet P reaches the secondary transfer position is adjusted by changing the carrying speed of the sheet P in accordance with the timing that the toner images carried on the surface of the transfer belt 161 reach the secondary transfer position.

To the secondary transfer roller 166, a transfer voltage is applied by the high-voltage supply 166*a*, and once the sheet P has reached the secondary transfer position, the toner images carried on the surface of the transfer belt 161 are transferred to the sheet P. Once the toner images are transferred to the sheet P in the secondary transfer position, the sheet P reaches the fuser unit 170 disposed in the downstream side of the secondary transfer position in the sheet carrying direction.

When the sheet P, to which the toner images are transferred, has been carried to the fuser unit 170 and passes between the fuser roller 171 and the backup roller 172, heat and pressure are applied to the sheet P to have the toner images fused on the sheet P.

When the main controller 101*a* has received the print command to execute rear-side printing, the main controller 101*a* controls the separator solenoid 181*a* so that the sheet P is carried to the medium reversing part 180. Once the sheet P is switched back by the switchback roller pair 182, the sheet P is carried again to the secondary transfer position by the carrying roller pairs 183 and 184, and rear-side printing of the sheet P is executed. Once the toner images are transferred to the sheet P in the secondary transfer position, the sheet P reaches the fuser unit 170 disposed in the downstream side of the secondary transfer position in the sheet carrying direction.

The sheet P, to which the toner images are fused, is ejected by the ejection roller pair 191 to the outside of the image forming apparatus 100.

<Operations of Pressing Force Variable Mechanism 130>

Next, the operations of the pressing force variable mechanism 130 during monochrome printing in the image forming apparatus 100 are specifically explained.

In printing on a thick sheet of paper or a medium of high rigidity in the image forming apparatus 100, when the tip of the sheet P enters a nip part (roller nip) between the fuser roller 171 and the backup roller 172 of the fuser unit 170, the load that the fuser roller 171 and the backup roller 172 sandwich the sheet P influences carrying the sheet P in some cases. Specifically, when the fuser roller 171 and the backup roller 172 sandwich the sheet P, the carrying speed of the sheet P instantaneously changes in some cases. This change is transmitted to the transfer belt 161 in the secondary transfer position, and the drive speed (rotation speed) of the transfer belt 161 instantaneously changes.

Also, when the rear end of the sheet P passes the first separation roller 143*a* and the second registration roller pair 145, the carrying speed of sheet P also changes instantaneously in some cases. This change is transmitted to the transfer belt 161 in the secondary transfer position, and the drive speed (rotation speed) of the transfer belt 161 instantaneously changes.

If the drive speed of the transfer belt 161 changes, a shift in the relative speed between the transfer belt 161 and each of the photosensitive drums 111Y, 111M, 111C, and 111K occurs in the primary transfer position. This shift in the relative speed may generate slipping on the contact surfaces between the transfer belt 161 and each of the photosensitive drums 111Y, 111M, 111C, and 111K and generate belt-like disturbances in the toner images transferred to the surface of the transfer belt 161 in the primary transfer position in some cases.

When performing monochrome printing, because the image forming units 110Y, 110M, and 110C used for color printing move to the non-image forming positions, in the primary transfer position, the transfer belt 161 receives pressing forces of the image forming unit 110K and the primary transfer part 120K only. Therefore, during monochrome printing, the carrying speed of the transfer belt 161 can be easily influenced by external forces. That is, it becomes easier for the change in the carrying speed of the sheet P to influence the transfer belt 161, and it becomes easier for a shift in the relative speed between the transfer belt 161 and the photosensitive drum 111K to occur in the primary transfer position. This shift in the relative speed generates slipping on the contact surfaces between the transfer belt 161 and the photosensitive drum 111K and generates a belt-like disturbance in the black toner image transferred to the surface of the transfer belt 161 in the primary transfer part 120K in some cases.

During color printing, the multiple image forming units 110Y, 110M, 110C, and 110K are each in contact with the transfer belt 161. Specifically, the multiple photosensitive drums 111Y, 111M, 111C, and 111K are each biased by the primary transfer parts 120Y, 120M, 120C, and 120K across the transfer belt 161 to be in contact with the transfer belt 161. Therefore, in the primary transfer position, because the transfer belt 161 receives pressing forces by the image forming units 110Y, 110M, 110C, and 110K and the primary transfer parts 120Y, 120M, 120C, and 120K, it is harder for the carrying speed of the transfer belt 161 to be influenced by external forces than during monochrome printing.

Figure 8:
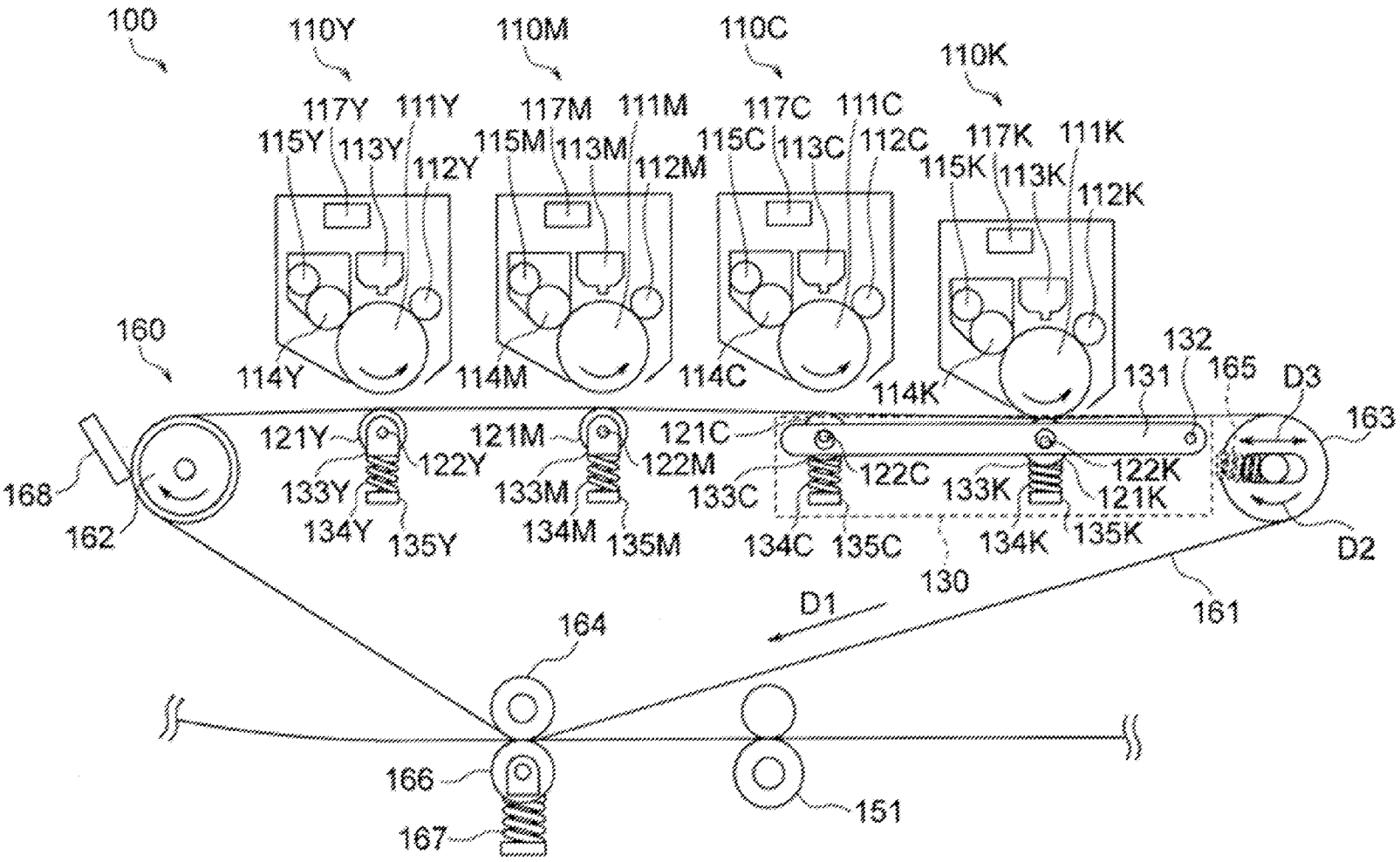
FIG. 8 is a cross-sectional view showing the enlarged main part of the image forming apparatus during monochrome printing.

FIG. 8 is an enlarged cross-sectional view of the main part of the image forming apparatus 100 during monochrome printing. As shown in FIG. 8, when performing monochrome printing, the image forming units 110Y, 110M, and 110C used for color printing come into a state separated from the transfer belt 161. For example, when switching from color printing to monochrome printing, the image forming units 110Y, 110M, and 110C move from the image forming positions to the non-image forming positions.

Specifically, once the image data are processed by the data processing part 101*c* and the print command for monochrome printing is sent to the main controller 101*a*, the main controller 101*a* controls the up-down solenoids 117Y, 117M, and 117C to move the image forming units 110Y, 110M, and 110C to the non-image forming positions.

When the image forming unit 110C has moved to the non-image forming position, the pressing force variable mechanism 130 moves the primary transfer part 120C in the direction to stretch the transfer belt 161 by the primary transfer part 120C, interlocked with the movement of the image forming unit 110C to the non-image forming position.

Specifically, because the spring 134C included in the pressing force variable mechanism 130 biases the primary transfer part 120C, as the image forming unit 110C moves from the image forming position to the non-image forming position, the primary transfer part 120C moves in the direction biased by the spring 134C. Because the primary transfer part 120C is pressed up in the direction toward the image forming unit 110C by the spring 134C, the transfer belt 161 is stretched by the primary transfer part 120C. That is, the primary transfer part 120C moves so as to stretch the transfer belt 161, interlocked with the movement of the image forming unit 110C to the non-image forming position.

In the same manner, because the springs 134Y and 134M, along with the spring 134C, bias the primary transfer parts 120Y and 120M, respectively, as the image forming units 110Y and 110M move from the image forming positions to the non-image forming positions, the primary transfer parts 120Y and 120M move in the direction biased by the springs 134Y and 134M. Because the primary transfer parts 120Y and 120M are pressed up in the direction toward the image forming units 110Y and 110M by the springs 134Y and 134M, respectively, the transfer belt 161 is stretched also by the primary transfer parts 120Y and 120M along with the primary transfer part 120C. That is, in the same manner as the primary transfer part 120C, the primary transfer parts 120Y and 120M move so as to stretch the transfer belt 161, interlocked with the movements of the image forming units 110Y and 110M to the non-image forming positions.

The image forming units 110Y, 110M, and 110C rest in the non-image forming positions, and the movements of the primary transfer parts 120Y, 120M, and 120C stop in the positions where the transfer belt 161 is stretched to a certain extent by the primary transfer parts 120Y, 120M, and 120C. When the primary transfer parts 120Y, 120M, and 120C have stopped, the image forming units 110Y, 110M, and 110C and the transfer belt 161 are separated from each other.

Once the primary transfer part 120C moves in the direction to stretch the transfer belt 161, because the roller shaft 122C and the first hole part 131*a* are engaged with each other, the link 131 is pressed up. Specifically, the link 131 rotates having the fulcrum part 132 as its fulcrum, interlocked with the movement of the primary transfer part 120C.

The link 131 is also engaged with the roller shaft 122K of the primary transfer part 120K at the second hole part 131*b*. Therefore, the link 131 applies a force to the primary transfer part 120K so as to press up the primary transfer part 120K in the direction toward the image forming unit 110K, interlocked with the movement of the primary transfer part 120C.

That is, the pressing force variable mechanism 130 changes the pressing force between the image forming unit 110K and the primary transfer part 120K through the transfer belt 161, interlocked with the movement of the image forming unit 110C to the non-image forming position.

Specifically, the pressing force variable mechanism 130 links the primary transfer part 120C and the primary transfer part 120K by the link 131, and therefore applies a bias force in the same direction as the bias force by the spring 134C to the primary transfer part 120K through the link 131. Because the primary transfer part 120K is biased by the spring 134K in the direction toward the image forming unit 110K, with the bias force by the spring 134C further applied to the primary transfer part 120K through the link 131, the force of the primary transfer part 120K toward the image forming unit 110K increases.

Because the image forming unit 110K does not move even if the force of the primary transfer part 120K toward the image forming unit 110K increased, the pressing force between the image forming unit 110K and the primary transfer part 120K through the transfer belt 161 during monochrome printing becomes greater than the pressing force between the image forming unit 110K and the primary transfer part 120K through the transfer belt 161 during color printing.

Therefore, during monochrome printing, the pressing force variable mechanism 130 increases the bias force to the primary transfer part 120K to increase the nip pressure between the surface of the transfer belt 161 and the surface of the photosensitive drum 111K Once the nip pressure between the surface of the transfer belt 161 and the surface of the photosensitive drum 111K has increased, the frictional force between the surface of the transfer belt 161 and the surface of the photosensitive drum 111K increases, thereby slipping on the contact surfaces between the transfer belt 161 and the photosensitive drum 111K can be reduced.

According to Embodiment 1, because the pressing force variable mechanism 130 increases the pressing force between the image forming unit 110K and the primary transfer part 120K through the transfer belt 161, interlocked with the movement of the image forming unit 110C from the image forming position to the non-image forming position, the frictional force between the surface of the transfer belt 161 and the surface of the photosensitive drum 111K can be increased. Therefore, during monochrome printing by the image forming apparatus 100, slipping on the contact surfaces between the transfer belt 161 and the photosensitive drum 111K can be suppressed, thereby disturbances in the toner images transferred to the surface of the transfer belt 161 in the primary transfer position of the image forming unit 110K can be reduced. Therefore, according to Embodiment 1, the image forming apparatus 100 that can realize high-quality image formation can be offered.

Embodiment 2

Next, an image forming apparatus 200 of Embodiment 2 is explained. The image forming apparatus 200 is different from the image forming apparatus 100 of Embodiment 1 in being a direct transfer type color tandem electrophotographic device, and is the same as the image forming apparatus 100 of Embodiment 1 in the other respects. Therefore, in explaining the image forming apparatus 200 of Embodiment 2, its components that are identical with or correspond to those of the image forming apparatus 100 of Embodiment 1 are assigned the same codes as in the image forming apparatus 100 of Embodiment 1 and their explanations are omitted.

Figure 9:
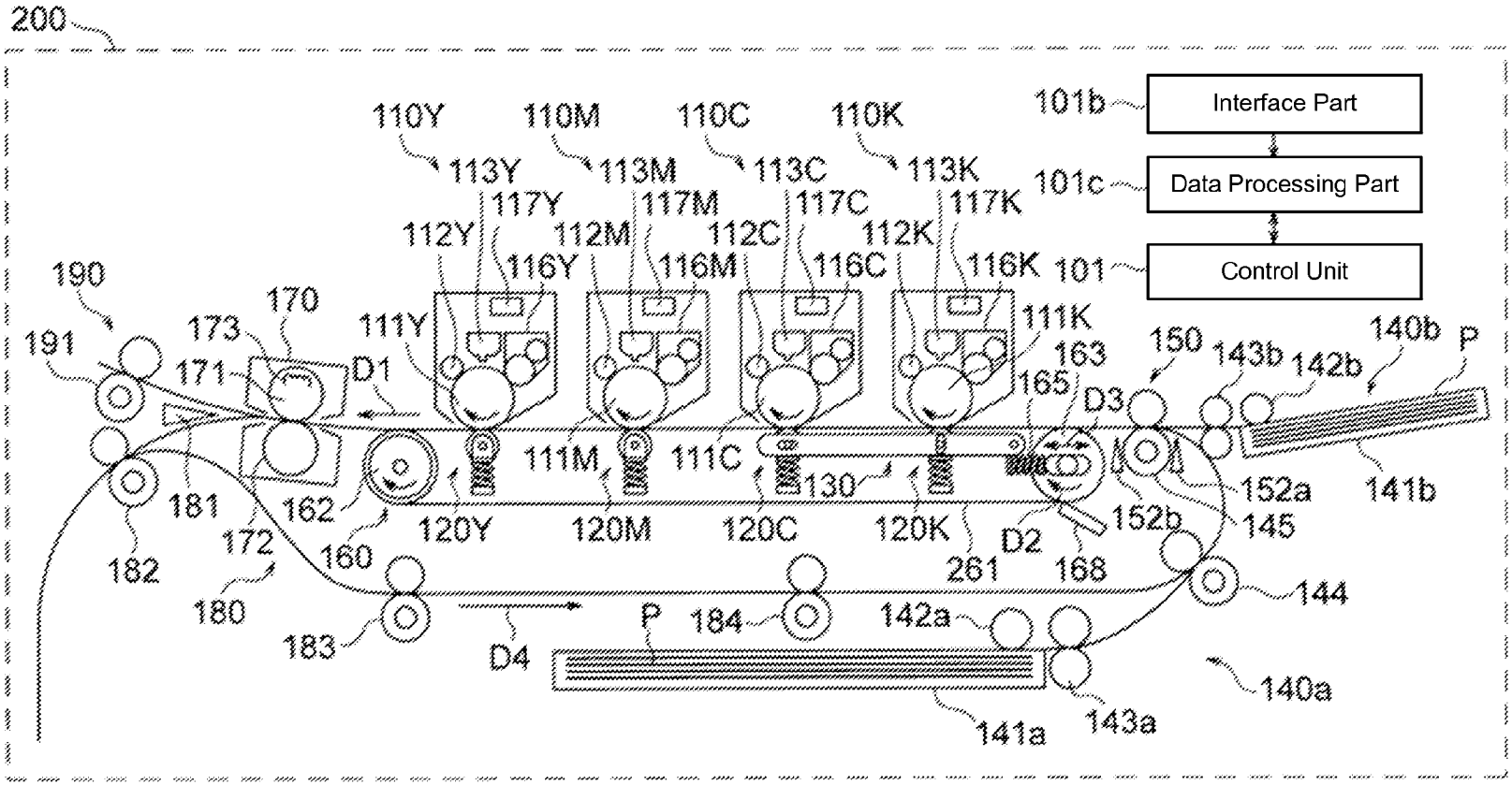
FIG. 9 is a cross-sectional view showing schematically the structure of the image forming apparatus of Embodiment 2 of this invention.
Figure 10:
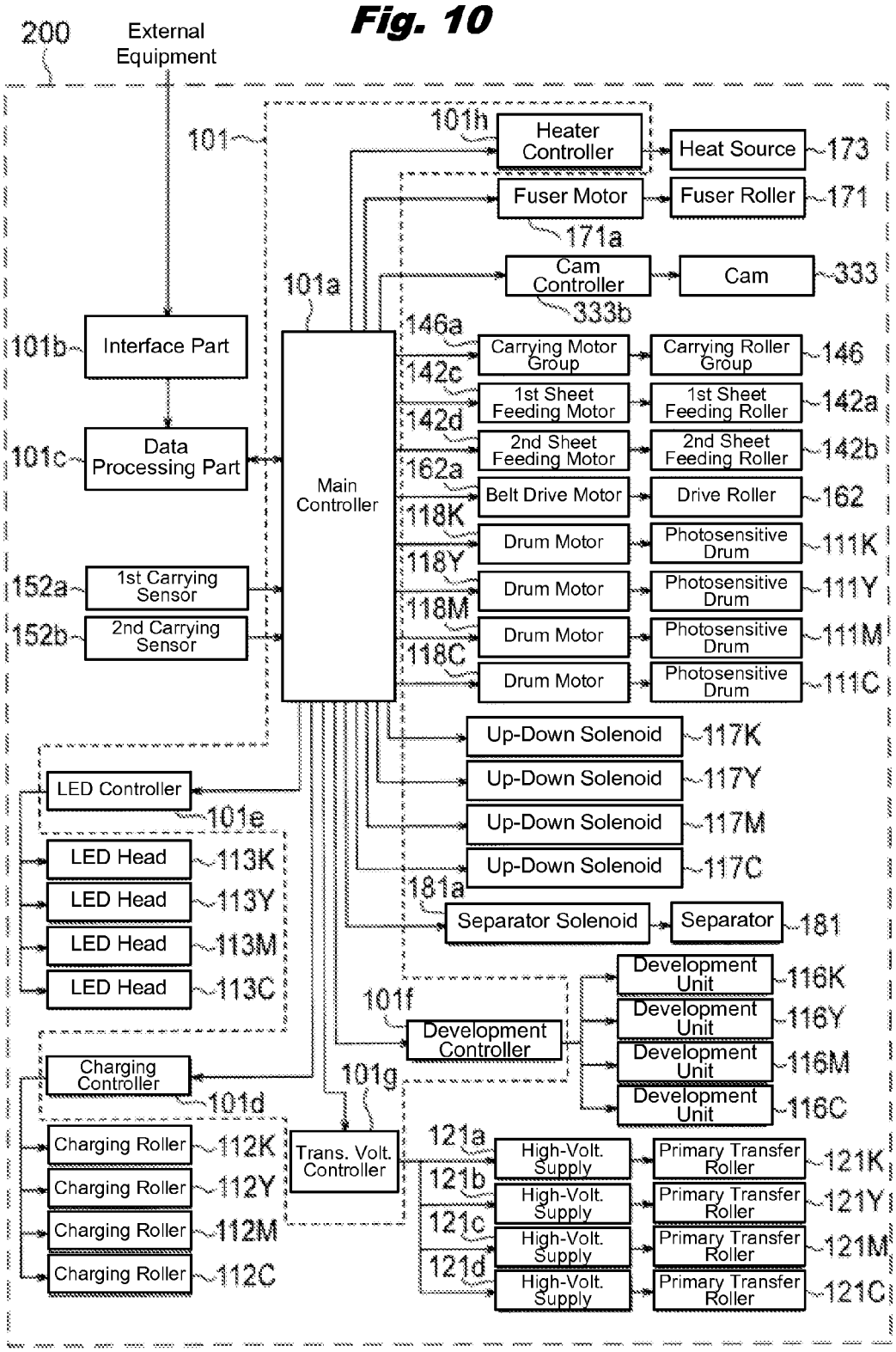
FIG. 10 is a block diagram showing schematically the configuration of the image forming apparatus shown in FIG. 9.
Figure 11:
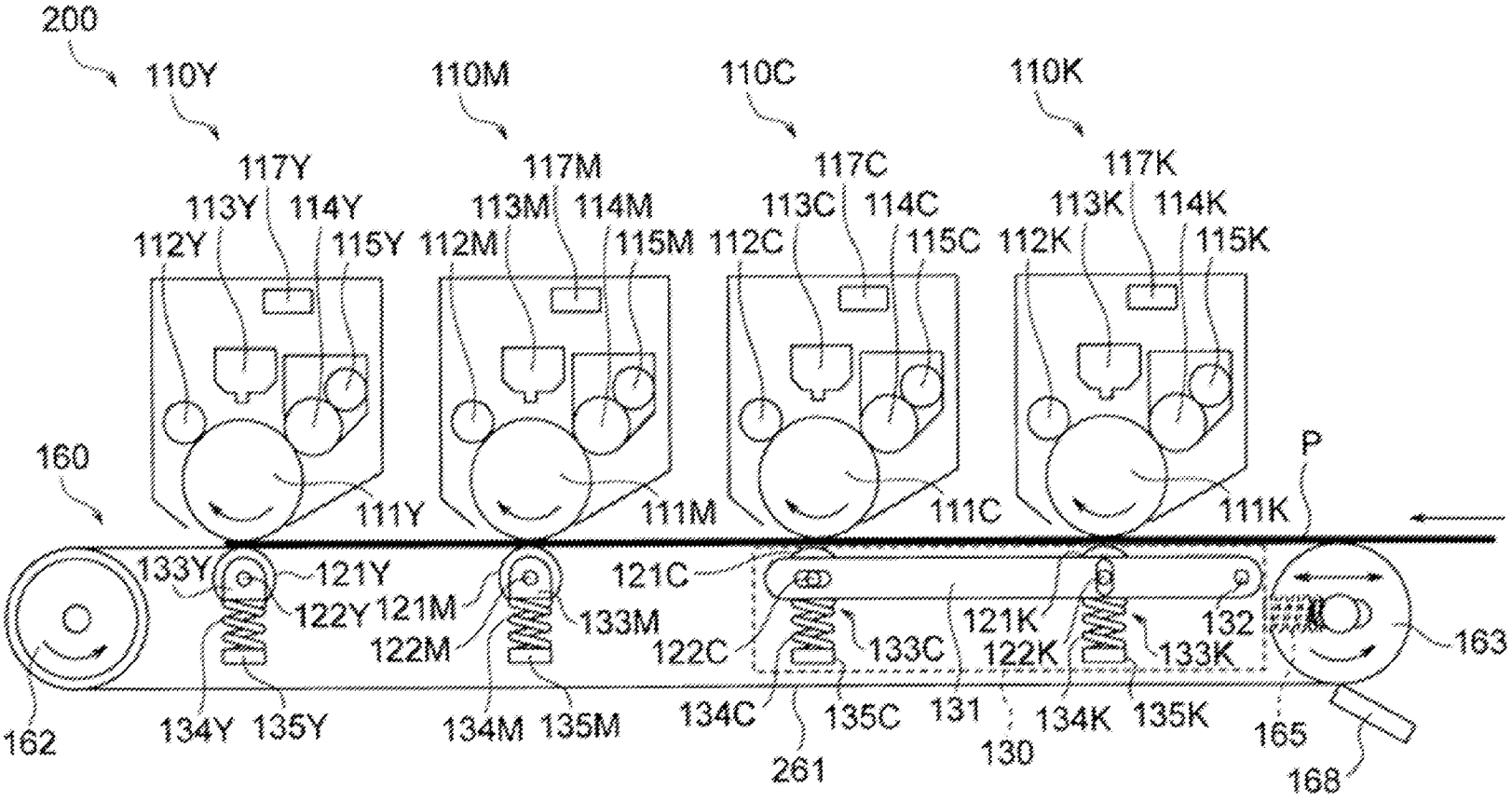
FIG. 11 is a cross-sectional view showing the enlarged main part of the image forming apparatus during color printing.

FIG. 9 is a cross-sectional view showing schematically the structure of the image forming apparatus 200 of Embodiment 2 of this invention. FIG. 10 is a block diagram showing schematically the configuration of the image forming apparatus 200 shown in FIG. 9. FIG. 11 is an enlarged cross-sectional view showing the main part of the image forming apparatus 200 during color printing.

In the image forming apparatus 200 of Embodiment 2, its differences from the image forming apparatus 100 of Embodiment 1 are explained.

In Embodiment 2, the "image forming position" denotes a position in contact with a carrying member, such as the position where an image forming unit (image forming unit 110Y, 110M, 110C, or 110K) is in contact with a transfer belt 261.

In Embodiment 2, the "non-image forming position" denotes a position separated from the carrying member, such as the position where an image forming unit (image forming unit 110Y, 110M, 110C, or 110K) is separated from the transfer belt 261.

The image forming apparatus 200 comprises a transfer belt 261 as a carrying member that carries a sheet P as a medium, multiple image forming units 110Y, 110M, and 110C (first image forming units) and 110K (second image forming unit) disposed along the carrying direction of the transfer belt 261, and multiple primary transfer parts 120Y, 120M, 120C, and 120K as multiple transfer parts that transfer toner images formed respectively in the multiple image forming units 110Y, 110M, 110C, and 110K to the sheet P.

Also, the image forming apparatus 200 comprises a pressing force variable mechanism 130 that changes the pressing force between the image forming unit 110K and the primary transfer part 120K across the transfer belt 261.

Also, the image forming apparatus 200 comprises an interface part 101*b*, a data processing part 101*c*, a control unit 101 that controls the whole operation of the image forming apparatus 200, a first sheet feeding part 140*a* and a second sheet feeding part 140*b* that feed the sheet P (print sheet) as a medium, a medium carrying part 150 that carries the sheet P fed from the first sheet feeding part 140*a* or the second sheet feeding part 140*b*, a transfer belt unit 260 including the transfer belt 261, a fuser unit 170 that fuses toner images transferred to the sheet P, a medium reversing part 180 for reversing the sheet P and performing rear-side printing, and an ejection part 190 that ejects the printed (image-formed) sheet P to the outside of the image forming apparatus 200.

The image forming units 110Y, 110M, 110C, and 110K store yellow, magenta, cyan, and black developers (including power toners), respectively, and form images using these yellow (Y), magenta (M), cyan (C), and black (K) developers. The image forming units 110Y, 110M, 110C, and 110K of respective colors are disposed in the order of the image forming unit 110Y, the image forming unit 110M, the image forming unit 110C, and the image forming unit 110K from the downstream side in the carrying direction of the transfer belt 261 as a carrying member mentioned below.

The image forming unit used for image formation during monochrome printing is regarded as the second image forming unit, and one of the image forming units other than the second image forming unit is regarded as the first image forming unit. The second image forming unit is positioned in the upstream side of the first image forming unit in the carrying direction (rotation direction) of the transfer belt 261. In Embodiment 2, the image forming unit disposed in the most upstream-side position in the carrying direction of the transfer belt 261 is regarded as the second image forming unit.

The first image forming unit is one of the image forming units disposed in the downstream side of the second image forming unit in the carrying direction of the transfer belt 261. For example, in Embodiment 2, the first image forming unit is the image forming unit 110C, and the second image forming unit is the image forming unit 110K. However, the first image forming unit and the second image forming unit are not limited by the colors or kinds of the stored developers.

The image forming unit 110K that forms the black toner image is disposed in the most upstream-side position in the carrying direction of the transfer belt 261 among the multiple image forming units 110Y, 110M, 110C, and 110K. In other words, the image forming unit 110K is positioned between an idler roller 163 as a driven part mentioned below and the image forming unit 110C.

Up-down solenoids 170Y, 170M, 170C, and 170K are controlled by a main controller 101*a*. The up-down solenoids 170Y, 170M, 170C, and 170K selectively move the image forming units 110Y, 110M, 110C, and 110K, respectively, to either the image forming positions or the non-image forming positions based on commands from the main controller 101*a*. Therefore, each of the multiple image forming units 110Y, 110M, 110C, and 110K can move to either the image forming position or the non-image forming position.

The transfer belt unit 260 comprises an endless transfer belt 261 as a carrying member that carries the sheet P, a drive roller 162 as a drive part that circulatorily rotates the transfer belt 261, and an idler roller 163 as a driven part that has the transfer belt 261 stretched (stretched over with tension applied) together with the drive roller 162 with appropriate tension.

Also, the transfer belt unit 260 comprises a spring 165 as an elastic member that biases the rotation shaft of the idler roller 163 to have the transfer belt 261 stretched with appropriate tension, and a cleaning member 168 (for example, a cleaning blade) supported by the frame of the transfer belt unit 260 in a position opposing the drive roller 162 across the transfer belt 261.

The transfer belt 261 of the transfer belt unit 260 carries the sheet P, to which the toner images formed in the multiple image forming units 110Y, 110M, 110C, and 110K are transferred, to the fuser unit 170.

The transfer belt 261 is an endless belt made of a resin material (for example, a polyimide resin) stretched by multiple rollers (for example, the drive roller 162 and the idler roller 163) inside the transfer belt unit 260 and circulatorily rotates in the direction of an arrow D1 shown in FIG. 9.

The drive roller 162 is rotatably supported by the frame of the transfer belt unit 260 and receives a drive force from the belt drive motor 162*a*. The belt drive motor 162*a* is provided inside the image forming apparatus 200 and operates by receiving a control by the main controller 101*a* to rotate the drive roller 162 through a drive force transmission mechanism such as a gear.

The idler roller 163 is supported rotatably in the direction of an arrow D2 shown in FIG. 9 by having its rotation shaft supported by a bearing supported by the frame of the transfer belt unit 260. The bearing of the idler roller 163 rotatably supports the idler roller 163 and at the same time supports the idler roller 163 movably in a direction perpendicular to the rotation shaft (the direction of an arrow D3). That is, the bearing of the idler roller 163 supports the rotation shaft of the idler roller 163 movably in a direction to either strengthen or weaken the tension of the transfer belt 261.

The cleaning member 168 is fixed to the frame of the transfer belt unit 260 having the tip of the cleaning member 168 in contact with the surface of the transfer belt 261, and removes dusts on the transfer belt 261.

<Configuration of the Primary Transfer Parts 120Y, 120M, 120C, and 120K>

The multiple primary transfer parts 120Y, 120M, 120C, and 120K are disposed opposing their corresponding image forming units 110Y, 110M, 110C, and 110K, respectively, across the transfer belt 261. Specifically, the multiple primary transfer parts 120Y, 120M, 120C, and 120K, together with the photosensitive drums 111Y, 111M, 111C, and 111K in the corresponding image forming units 110Y, 110M, 110C, and 110K, respectively, are disposed so as to sandwich the transfer belt 261.

For example, the primary transfer part 120Y as a transfer part is disposed biased by a below-mentioned spring 134Y in a position opposing the photosensitive drum 111Y of the image forming unit 110Y across the transfer belt 261 so as to sandwich the transfer belt 261 together with the photosensitive drum 111Y. The primary transfer part 120M as a transfer part is disposed biased by a below-mentioned spring 134M in a position opposing the photosensitive drum 111M of the image forming unit 110M across the transfer belt 261 so as to sandwich the transfer belt 261 together with the photosensitive drum 111M.

The primary transfer part 120C as a transfer part (first transfer part) is disposed biased by a below-mentioned spring 134C in a position opposing the photosensitive drum 111C of the image forming unit 110C across the transfer belt 261 so as to sandwich the transfer belt 261 together with the photosensitive drum 111C. The primary transfer part 120K as a transfer part (second transfer part) is disposed biased by a below-mentioned spring 134K in a position opposing the photosensitive drum 111K of the image forming unit 110K across the transfer belt 261 so as to sandwich the transfer belt 261 together with the photosensitive drum 111K.

However, when performing monochrome printing, because the image forming units 110Y, 110M, and 110C used for color printing move to the non-image forming positions, the photosensitive drums 111Y, 111M, and 111C separate from the transfer belt 261.

The transfer part disposed in the most upstream side in the carrying direction of the transfer belt 261 is regarded as the second transfer part, and one of the transfer parts disposed in the downstream side of the second transfer part is regarded as the first transfer part. In Embodiment 2, for example, the first transfer part is the primary transfer part 120C, and the second transfer part is the primary transfer part 120K. Note that the first transfer part is a transfer part opposing the first image forming unit across the carrying member, and the second transfer unit is a transfer unit opposing the second image forming unit across the carrying member.

The primary transfer part 120Y transfers a toner image formed on the photosensitive drum 111Y to the sheet P. The primary transfer part 120Y comprises a primary transfer roller 121Y to which a voltage (transfer bias) is applied from a high-voltage supply 121*b*, and a roller shaft 122Y that is the rotation shaft of the primary transfer roller 121Y. Besides, the high-voltage supply 121*b* is provided inside the image forming apparatus 200 and controlled by the transfer voltage controller 101*g*.

The image forming apparatus 200 comprises a holder 133Y (bearing) as a bearing part that rotatably holds both ends of the roller shaft 122Y and holds one end side of a below-mentioned spring 134Y, a spring 134Y as a bias part that is held between the holder 133Y and a below-mentioned receiving part 135Y and biases the primary transfer roller 121Y toward the photosensitive drum 111Y of the image forming unit 110Y through the holder 133Y, and a receiving part 135Y that is fixed to the frame of the transfer belt unit 260 and holds the other end side (the opposite side of the holder 133Y side) of the spring 134Y. However, the other end side of the spring 134Y may be directly fixed to the frame of the transfer belt unit 260 or the chassis of the image forming apparatus 200.

The holder 133Y is guided by the frame of the transfer belt unit 260 movably in a direction perpendicular to the roller shaft 122Y (the direction toward the photosensitive drum 111Y and the direction away from the photosensitive drum 111Y). The holder 133Y rotatably supports both ends of the roller shaft 122Y and supports the primary transfer part 120Y movably in a direction perpendicular to the roller shaft 122Y (the direction toward the photosensitive drum 111Y and the direction away from the photosensitive drum 111Y).

The primary transfer part 120M transfers a toner image formed on the photosensitive drum 111M to the sheet P. The primary transfer part 120M comprises a primary transfer roller 121M to which a voltage (transfer bias) is applied from a high-voltage supply 121*c*, and a roller shaft 122M that is the rotation shaft of the primary transfer roller 121M. Besides, the high-voltage supply 121*c* is provided inside the image forming apparatus 200 and controlled by the transfer voltage controller 101*g*.

The image forming apparatus 200 comprises a holder 133M (bearing) as a bearing part that rotatably holds both ends of the roller shaft 122M and holds one end side of a below-mentioned spring 134M, a spring 134M as a bias part that is held between the holder 133M and a below-mentioned receiving part 135M and biases the primary transfer roller 121M toward the photosensitive drum 111M of the image forming unit 110M through the holder 133M, and a receiving part 135M that is fixed to the frame of the transfer belt unit 260 and holds the other end side (the opposite side of the holder 133M side) of the spring 134M. However, the other end side of the spring 134M may be directly fixed to the frame of the transfer belt unit 260 or the chassis of the image forming apparatus 200.

The holder 133M is guided by the frame of the transfer belt unit 260 movably in a direction perpendicular to the roller shaft 122M (the direction toward the photosensitive drum 111M and the direction away from the photosensitive drum 111M). The holder 133M rotatably supports both ends of the roller shaft 122M and at the same time supports the primary transfer part 120M movably in a direction perpendicular to the roller shaft 122M (the direction toward the photosensitive drum 111M and the direction away from the photosensitive drum 111M).

The primary transfer part 120C transfers a toner image formed on the photosensitive drum 111C to the sheet P. The primary transfer part 120C comprises a primary transfer roller 121C to which a voltage (transfer bias) is applied from a high-voltage supply 121*d*, and a roller shaft 122C that is the rotation shaft of the primary transfer roller 121C. Both ends of the roller shaft 122C are rotatably held by a below-mentioned holder 133C of the pressing force variable mechanism 130. Besides, the high-voltage supply 121*d* is provided inside the image forming apparatus 200 and controlled by the transfer voltage controller 101*g*.

The primary transfer part 120K transfers a toner image formed on the photosensitive drum 111K to the sheet P. The primary transfer part 120K comprises a primary transfer roller 121K to which a voltage (transfer bias) is applied from a high-voltage supply 121*a*, and a roller shaft 122K that is the rotation shaft of the primary transfer roller 121K. Both ends of the roller shaft 122K are rotatably held by a below-mentioned holder 133K of the pressing force variable mechanism 130. Besides, the high-voltage supply 121*a* is provided inside the image forming apparatus 200 and controlled by the transfer voltage controller 101*g*.

<Configuration of Control Unit 101>

The control unit 101 comprises the main controller 101*a*, a charging controller 101*d*, an LED controller 101*e*, a development controller 101*f*, the transfer voltage controller 101*g*, and a heater controller 101*h*.

The main controller 101*a* issues instructions to the individual controllers based on the print command (including image data) received from external equipment through the data processing part 101*c*. Based on the instructions from the main controller 101*a*, the charging controller 101*d* controls the charging biases applied to the charging rollers 112K, 112Y, 112M, and 112C. Based on the instructions (for example, image data) from the main controller 101*a*, the LED controller 101*e* controls light radiated from the LED heads 113K, 113Y, 113M, and 113C. Based on the instructions from the main controller 101*a*, the development controller 101*f* controls the development rollers 114K, 114Y, 114M, and 114C and the supply rollers 115K, 115Y, 115M, and 115C in the development units 116K, 116Y, 116M, and 116C. Based on the instructions from the main controller 101*a*, the transfer voltage controller 101*g* controls the transfer biases (primary transfer biases) applied to the primary transfer rollers 121K, 121Y, 121M, and 121C by the high-voltage supply 121*a*, 121*b*, 121*c*, and 121*d*, respectively. Based on the instructions from the main controller 101*a*, the heater controller 101*h* controls heating by the heat source 173.

<Operations of Image Forming Apparatus 200>

The operations of the image forming apparatus 200 are basically the same as the operations of the image forming apparatus 100 explained in Embodiment 1, except that the toner images formed in the image forming units 110K, 110C, 110M, and 110Y are directly transferred to the sheet P sequentially in the transfer position (primary transfer position) where the primary transfer rollers 121K, 121C, 121M, and 121Y are positioned.

<Operations of Pressing Force Variable Mechanism 130>

Next, explained specifically are the operations of the pressing force variable mechanism 130 during monochrome printing in the image forming apparatus 200.

In printing on a thick sheet of paper or a medium of high rigidity in the image forming apparatus 200, when the tip of the sheet P enters a nip part (roller nip) between the fuser roller 171 and the backup roller 172 of the fuser unit 170, the load that the fuser roller 171 and the backup roller 172 sandwich the sheet P may influence carrying the sheet P in some cases. Specifically, when the fuser roller 171 and the backup roller 172 sandwich the sheet P, the carrying speed of the sheet P may instantaneously change in some cases. This change is transmitted to the transfer belt 261 in the transfer position, and the drive speed (rotation speed) of the transfer belt 261 instantaneously changes.

If the drive speed of the transfer belt 261 changes, a shift in the relative speed between the transfer belt 261 and each of the photosensitive drums 111Y, 111M, 111C, and 111K occurs in the transfer position. This shift in the relative speed may generate slipping on the contact surfaces between the sheet P carried by the transfer belt 261 and each of the photosensitive drums 111Y, 111M, 111C, and 111K and generate belt-like disturbances in the toner images transferred to the sheet P in the transfer position in some cases.

When performing monochrome printing, because the image forming units 110Y, 110M, and 110C used for color printing move to the non-image forming positions, in the transfer position, the transfer belt 261 receives pressing forces by the image forming unit 110K and the primary transfer part 120K only. Therefore, during monochrome printing, the carrying speed (rotation speed) of the transfer belt 261 can be easily influenced by external forces. That is, it becomes easier for the change in the carrying speed of the sheet P to influence the transfer belt 261, and it becomes easier for a shift in the relative speed between the transfer belt 261 and the photosensitive drum 111K to occur in the transfer position. This shift in the relative speed may generate slipping on the contact surfaces between the sheet P carried by the transfer belt 261 and the photosensitive drum 111K and generate a belt-like disturbance in the black toner image transferred to the sheet P in the primary transfer position 120K in some cases.

During color printing, the multiple image forming units 110Y, 110M, 110C, and 110K are each in contact with the transfer belt 261. Specifically, the multiple photosensitive drums 111Y, 111M, 111C, and 111K are each biased by the primary transfer parts 120Y, 120M, 120C, and 120K through the transfer belt 261 to be in contact with the transfer belt 261. Therefore, in the transfer position, because the transfer belt 261 receives a pressing force by the image forming units 110Y, 110M, 110C, and 110K and the primary transfer parts 120Y, 120M, 120C, and 120K, it is harder for the carrying speed of the transfer belt 261 to be influenced by external forces than during monochrome printing.

Figure 12:
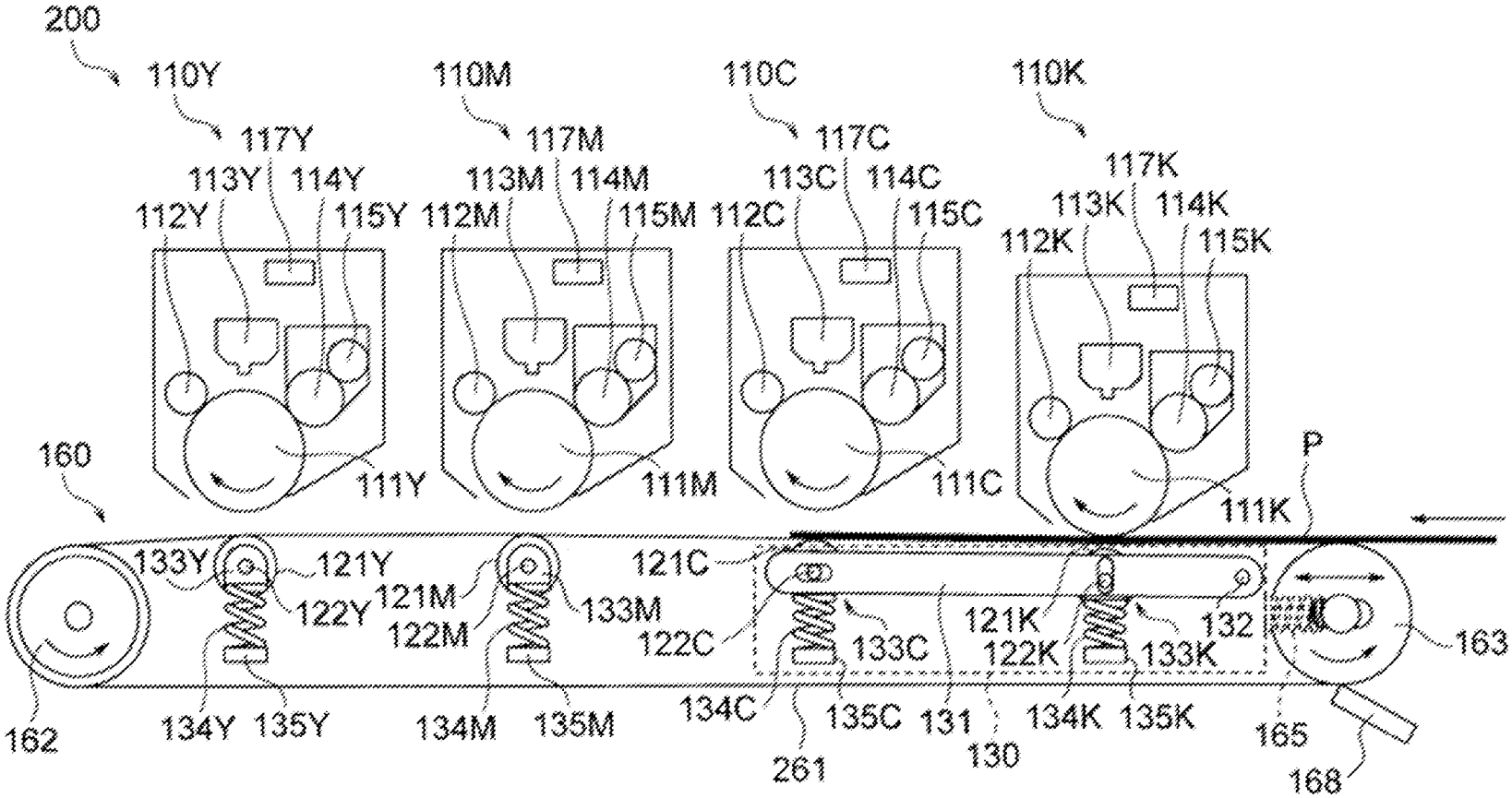
FIG. 12 is a cross-sectional view showing the enlarged main part of the image forming apparatus during monochrome printing.

FIG. 12 is an enlarged cross-sectional view of the main part of the image forming apparatus 200 during monochrome printing. As shown in FIG. 12, when performing monochrome printing, the image forming units 110Y, 110M, and 110C used for color printing come into a state separated from the transfer belt 261. For example, when switching from color printing to monochrome printing, the image forming units 110Y, 110M, and 110C move from the image forming positions to the non-image forming positions.

Specifically, once the image data are processed by the data processing part 101*c* and the print command for monochrome printing is sent to the main controller 101*a*, the main controller 101*a* controls the up-down solenoids 117Y, 117M, and 117C to move the image forming units 110Y, 110M, and 110C to the non-image forming positions.

When the image forming unit 110C has moved to the non-image forming position, the pressing force variable mechanism 130 moves the primary transfer part 120C in the direction to stretch the transfer belt 261 by the primary transfer part 120C, interlocked with the movement of the image forming unit 110C to the non-image forming position.

Specifically, because the spring 134C included in the pressing force variable mechanism 130 biases the primary transfer part 120C, as the image forming unit 110C moves from the image forming position to the non-image forming position, the primary transfer part 120C moves in the direction biased by the spring 134C. Because the primary transfer part 120C is pressed up in the direction toward the image forming unit 110C by the spring 134C, the transfer belt 261 is stretched by the primary transfer part 120C. That is, the primary transfer part 120C moves so as to stretch the transfer belt 261, interlocked with the movement of the image forming unit 110C to the non-image forming position.

In the same manner, because the springs 134Y and 134M along with the spring 134C bias the primary transfer parts 120Y and 120M, respectively, as the image forming units 110Y and 110M move from the image forming positions to the non-image forming positions, the primary transfer parts 120Y and 120M move in the direction biased by the springs 134Y and 134M. Because the primary transfer parts 120Y and 120M are pressed up in the direction toward the image forming units 110Y and 110M by the springs 134Y and 134M, respectively, the transfer belt 261 is stretched also by the primary transfer parts 120Y and 120M along with the primary transfer part 120C. That is, in the same manner as the primary transfer part 120C, the primary transfer parts 120Y and 120M move so as to stretch the transfer belt 261, interlocked with the movement of the image forming units 110Y and 110M to the non-image forming positions.

The image forming units 110Y, 110M, and 110C rest in the non-image forming positions, and the movements of the primary transfer parts 120Y, 120M, and 120C stop in the positions where the transfer belt 261 is stretched to a certain extent by the primary transfer parts 120Y, 120M, and 120C. When the primary transfer parts 120Y, 120M, and 120C have stopped, the image forming units 110Y, 110M, and 110C and the transfer belt 261 are separated from each other.

Once the primary transfer part 120C moves in the direction to stretch the transfer belt 261, because the roller shaft 122C and the first hole part 131*a* are engaged with each other, the link 131 is pressed up. Specifically, the link 131 rotates having the fulcrum part 132 as its fulcrum, interlocked with the movement of the primary transfer part 120C.

The link 131 is also engaged with the roller shaft 122K of the primary transfer part 120K at the second hole part 131*b*. Therefore, the link 131 applies a force to the primary transfer part 120K so as to press up the primary transfer part 120K in the direction toward the image forming unit 110K, interlocked with the movement of the primary transfer part 120C.

That is, the pressing force variable mechanism 130 changes the pressing force between the image forming unit 110K and the primary transfer part 120K through the transfer belt 261, interlocked with the movement of the image forming unit 110C to the non-image forming position.

Specifically, the pressing force variable mechanism 130 links the primary transfer part 120C and the primary transfer part 120K by the link 131, and therefore applies a bias force in the same direction as the bias force by the spring 134C to the primary transfer part 120K through the link 131. Because the primary transfer part 120K is biased by the spring 134K in the direction toward the image forming unit 110K, with the bias force by the spring 134C further applied to the primary transfer part 120K through the link 131, the force of the primary transfer 120K toward the image forming unit 110K increases.

Because the image forming unit 110K does not move even if the force of the primary transfer part 120K toward the image forming unit 110K increased, the pressing force between the image forming unit 110K and the primary transfer part 120K through the transfer belt 261 during monochrome printing becomes greater than the pressing force between the image forming unit 110K and the primary transfer part 120K through the transfer belt 261 during color printing.

Therefore, during monochrome printing, the pressing force variable mechanism 130 increases the bias force to the primary transfer part 120K to increase the nip pressure between the surface of the transfer belt 261 and the surface of the photosensitive drum 111K Once the nip pressure between the surface of the transfer belt 261 and the surface of the photosensitive drum 111K has increased, the frictional force between the surface of the sheet P carried by the transfer belt 261 and the surface of the photosensitive drum 111K increases, thereby slipping on the contact surfaces between the sheet P carried by the transfer belt 261 and the photosensitive drum 111K can be reduced.

According to Embodiment 2, because the pressing force variable mechanism 130 increases the pressing force between the image forming unit 110K and the primary transfer part 120K through the transfer belt 261, interlocked with the movement of the image forming unit 110C from the image forming position to the non-image forming position, the frictional force between the surface of the sheet P carried by the transfer belt 261 and the surface of the photosensitive drum 111K can be increased. Therefore, during monochrome printing by the image forming apparatus 200, slipping on the contact surfaces between the sheet P carried by the transfer belt 261 and the photosensitive drum 111K can be suppressed, thereby disturbances in the toner image transferred to the surface of the sheet P in the transfer position of the image forming unit 110K can be reduced.

Therefore, according to Embodiment 2, the image forming apparatus 200 that can realize high-quality image formation can be offered.

<<First Modification>>

Next, explained is an image forming apparatus 300 of a modification of the image forming apparatus 100 of Embodiment 1 and the image forming apparatus 200 of Embodiment 2. The image forming apparatus 300 has a different configuration of a pressing force variable mechanism 330 provided in the image forming apparatus 300 from the configurations of the pressing force variable mechanism 130 provided in the image forming apparatus 100 of Embodiment 1 and the pressing force variable mechanism 130 provided in the image forming apparatus 200 of Embodiment 2, and to the other respects the same configuration can be applied as the configurations in the image forming apparatus 100 of Embodiment 1 and the image forming apparatus 200 of Embodiment 2. Therefore, the components that are identical with or correspond to the components of the image forming apparatus 100 of Embodiment 1 and the image forming apparatus 200 of Embodiment 2 are assigned the same codes as in the image forming apparatus 100 of Embodiment 1 and the image forming apparatus 200 of Embodiment 2.

Figure 13A:
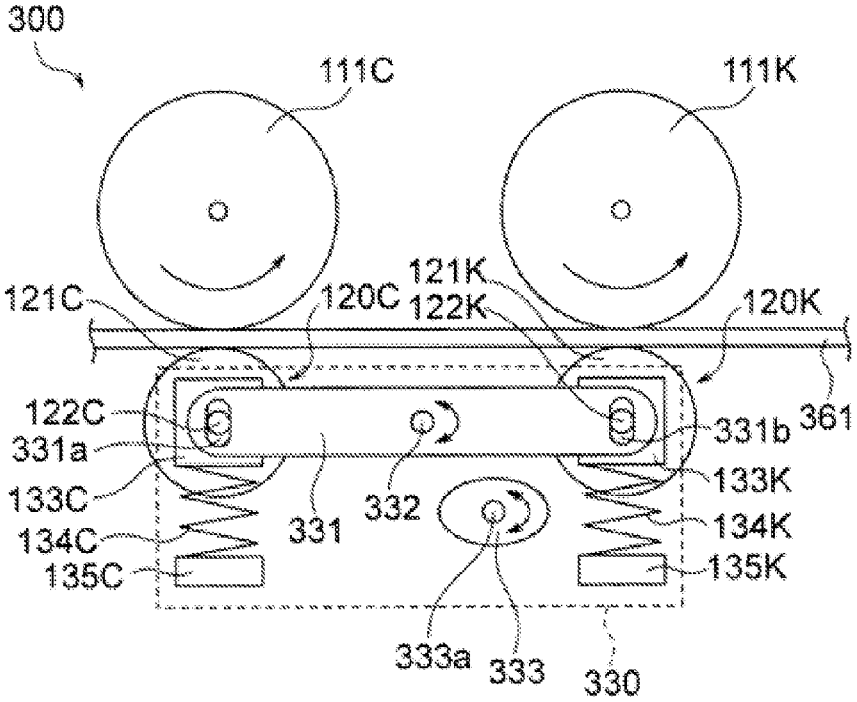
FIGS. 13A and 13B are enlarged side views showing the structure of a pressing force variable mechanism built in the image forming apparatus of the first modification.
Figure 13B:
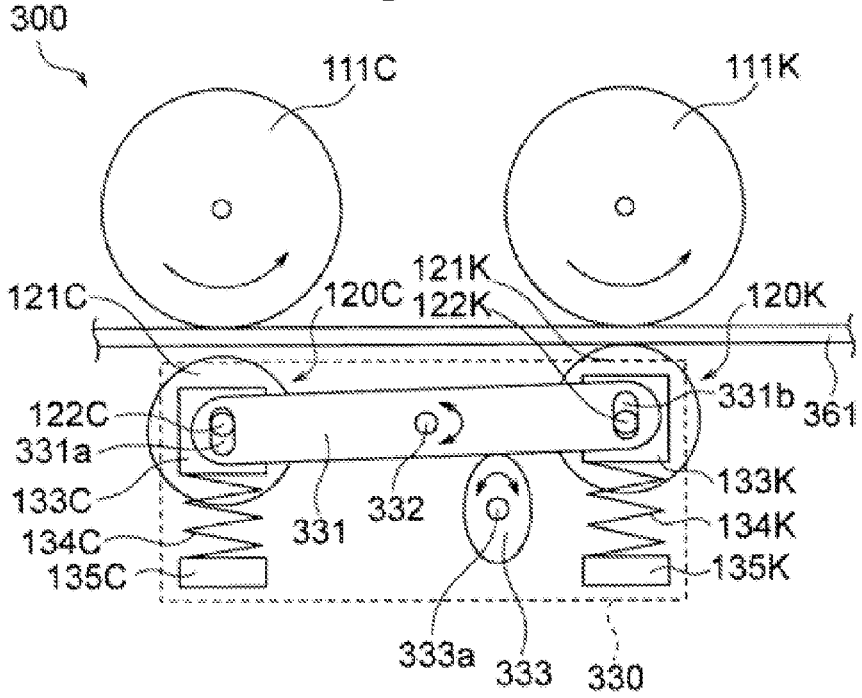
Figure 14:
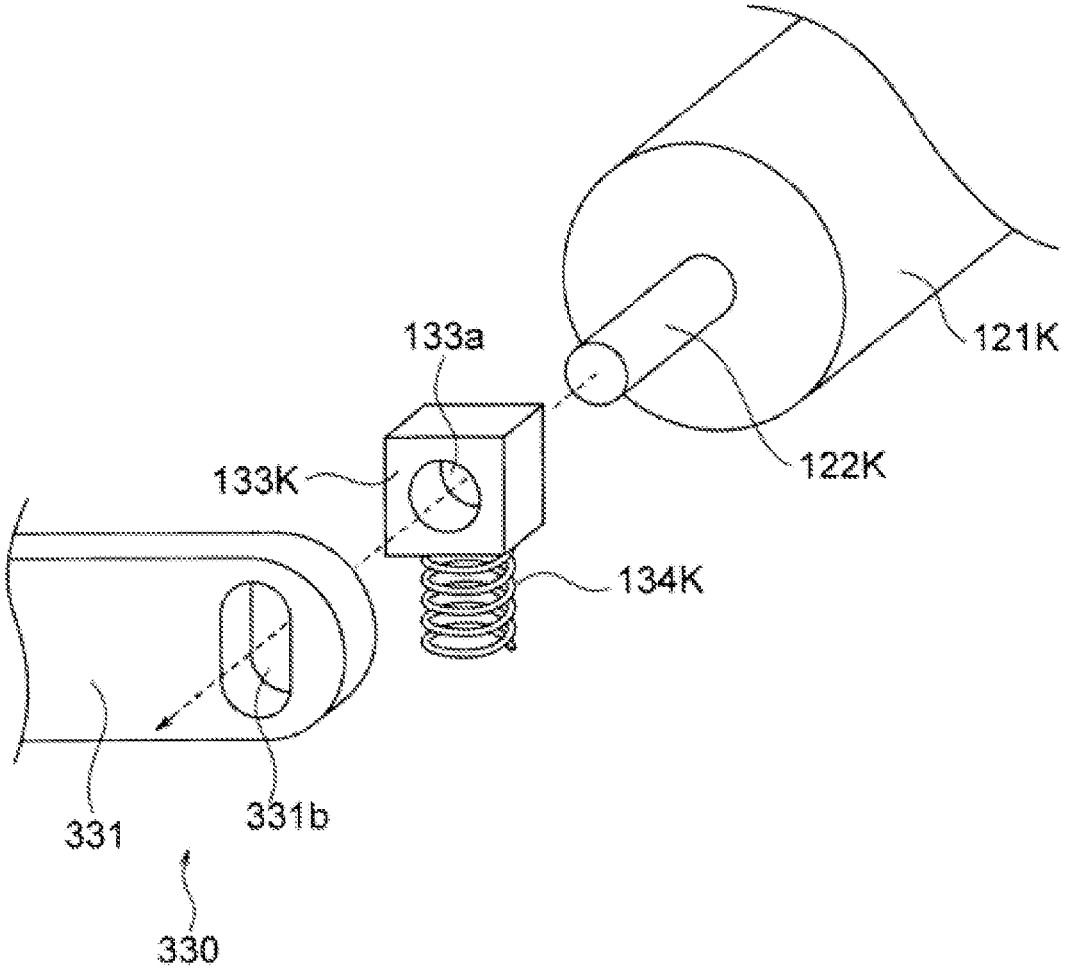
FIG. 14 is an exploded perspective view showing the assembly structure of a pressing force variable mechanism and a primary transfer part.

FIGS. 13A and 13B are enlarged side views showing the structure of a pressing force variable mechanism 330 built in the image forming apparatus 300 of the first modification. FIG. 14 is an exploded perspective view showing the assembly structure of the pressing force variable mechanism 330 and the primary transfer part 120K.

The image forming apparatus 300 shown in FIGS. 13A and 13B can be used as the intermediate transfer type color tandem electrophotographic device explained in Embodiment 1. Therefore, when using the image forming apparatus 300 as an intermediate transfer type color tandem electrophotographic device, a transfer belt 361 is a developer image carrier that carries toner images formed in the image forming units (for example, image forming units 110C and 110K).

Also, the image forming apparatus 300 shown in FIGS. 13A and 13B can be used as the direct transfer type color tandem electrophotographic device explained in Embodiment 2. Therefore, when using the image forming apparatus 300 as a direct transfer type color tandem electrophotographic device, the transfer belt 361 is a carrying member that carries a sheet as a medium, to which toner images formed in the image forming units (for example, the image forming units 110C and 110K) are transferred.

As shown in FIG. 13A, the pressing force variable mechanism 330 comprises holders 133C and 133K that hold roller shafts 122C and 122K of primary transfer rollers 121C and 121K, respectively.

Also, the pressing force variable mechanism 330 comprises a link 331 as a link part having a first hole part 331*a* and a second hole part 331*b* that loosely fit with the roller shafts 122C and 122K, a spring 134C as a first bias part that biases the primary transfer roller 121C toward a photosensitive drum 111C through the transfer belt 361, a spring 134K as a second bias part that biases the primary transfer roller 121K toward a photosensitive drum 111K through the transfer belt 361, and receiving parts 134 and 135.

Also, the pressing force variable mechanism 330 comprises a cam 333 that applies a force biasing the primary transfer roller 121K toward the image forming unit 110K through the link 331. The cam 333 comprises a rotation shaft 333*a* (first rotation shaft) and can freely rotate centering on the rotation shaft 333*a*.

The link 331 comprises a swing shaft 332 (second rotation shaft) provided between the primary transfer part 120C and the primary transfer part 120K. More specifically, the link 331 comprises the swing shaft 332 provided between the first hole part 331*a* and the second hole part 332*b*. Therefore, by rotating the cam 333, the pressing force variable mechanism 330 rotates the link 331 centering on the swing shaft 332.

The cam 333 should desirably be disposed in such a position as to come into contact with the link 331 between the swing shaft 332 and the primary transfer part 120K when the self (cam 333) has rotated. More specifically, the cam should desirably be disposed in such a position as to come into contact with the link 331 between the swing shaft 332 and the second hole part 331*b* in the sheet carrying path when the self (cam 333) has rotated.

As shown in FIG. 13B, by the cam 333 rotating to come into contact with the link 331 (hereafter, called the "contact state"), the pressing force variable mechanism 330 has the primary transfer roller 121C retreat to a non-image forming position that is a position separated from the transfer belt 361 and press up the primary transfer roller 121K toward the photosensitive drum 111K. That is, the primary transfer part 120C can move to either the non-image forming position or an image forming position that is a position contacting with the transfer belt 361.

One end sides of the springs 134C and 134K are held by the holders 133C and 133K, respectively, and the other end sides of the springs 134C and 134K are held by the receiving parts 134 and 135, respectively. However, the other end sides of the springs 134C and 134K may be directly fixed to the chassis of the image forming apparatus 300. The springs 134C and 134K bias the holders 133C and 133K, respectively.

As shown in FIG. 14, the roller shaft 122K is inserted to a hole part 133*a* that is a penetrating hole formed on the holder 133K, and inserted to the second hole part 331*b* of the link 331 through the holder 133K. As shown in FIG. 13A, when the link 331 and the cam 333 are not in the contact state, the first hole part 331*a* of the link 331 and the roller shaft 122C are loosely fit, and the second hole part 331*b* and the roller shaft 122K are loosely fit. Therefore, the primary transfer roller 121C is biased toward the photosensitive drum 111C by the bias force of the spring 134C, and the primary transfer roller 121K is biased toward the photosensitive drum 111K by the bias force of the spring 134K.

As shown in FIG. 13B, when the link 331 and the cam 333 are in the contact state, the pressing force variable mechanism 330 presses down the primary transfer roller 121C to the non-image forming position by the link 331 rotating centering on the swing shaft 332 to press down the roller shaft 122C with the top portion of the first hole part 331*a* of the link 331.

Because the swing shat 332 is positioned between the first hole part 331*a* and the second hole part 331*b*, by the cam 333 rotating, the primary transfer roller 121C descends to the non-image forming position, and the bottom portion of the second hole part 331*b* presses up the roller shaft 122K. Once the roller shaft 122K is pressed up, the primary transfer roller 121K is biased toward the photosensitive drum 111K, which changes the pressing force between the primary transfer part 120K and the image forming unit 110K through the transfer belt 361. Specifically, the pressing force variable mechanism 330 increases the pressing force between the primary transfer roller 121K and the photosensitive drum 111K through the transfer belt 361, interlocked with the movement of the primary transfer part 120C from the image forming position to the non-image forming position.

Therefore, the pressing force between the primary transfer part 120K and the image forming unit 110K when the primary transfer part 120C is positioned in the non-image forming position is greater than the pressing force between the primary transfer part 120K and the image forming unit 110K when the primary transfer part 120C is positioned in the image forming position.

Also, the pressing force variable mechanism 330 can change the pressing force between the primary transfer roller 121K and the photosensitive drum 111K through the transfer belt 361 by rotating the cam 333, interlocked with the movement of the image forming units 110Y, 110M, and 110C from the image forming positions to the non-image forming positions.

Besides, the cam 333 can be controlled by a cam controller 333*b* shown in FIG. 10, independently of the movements of the image forming units 110Y, 110M, and 110C to the non-image forming positions. Therefore, regardless of the positions (for example, the image forming positions or the non-image forming positions) of the image forming units 110Y, 110M, and 110C, the pressing force variable mechanism 330 can change the pressing force between the primary transfer part 120K and the image forming unit 110K through the transfer belt 361.

According to the image forming apparatus 300 of the first modification, because of having the same efficacy as the image forming apparatuses 100 and 200 explained in Embodiments 1 and 2, disturbances in a toner image transferred to the sheet P in the transfer position of the image forming unit 110K as the second image forming unit can be reduced.

<<Second Modification>>

Figure 15:
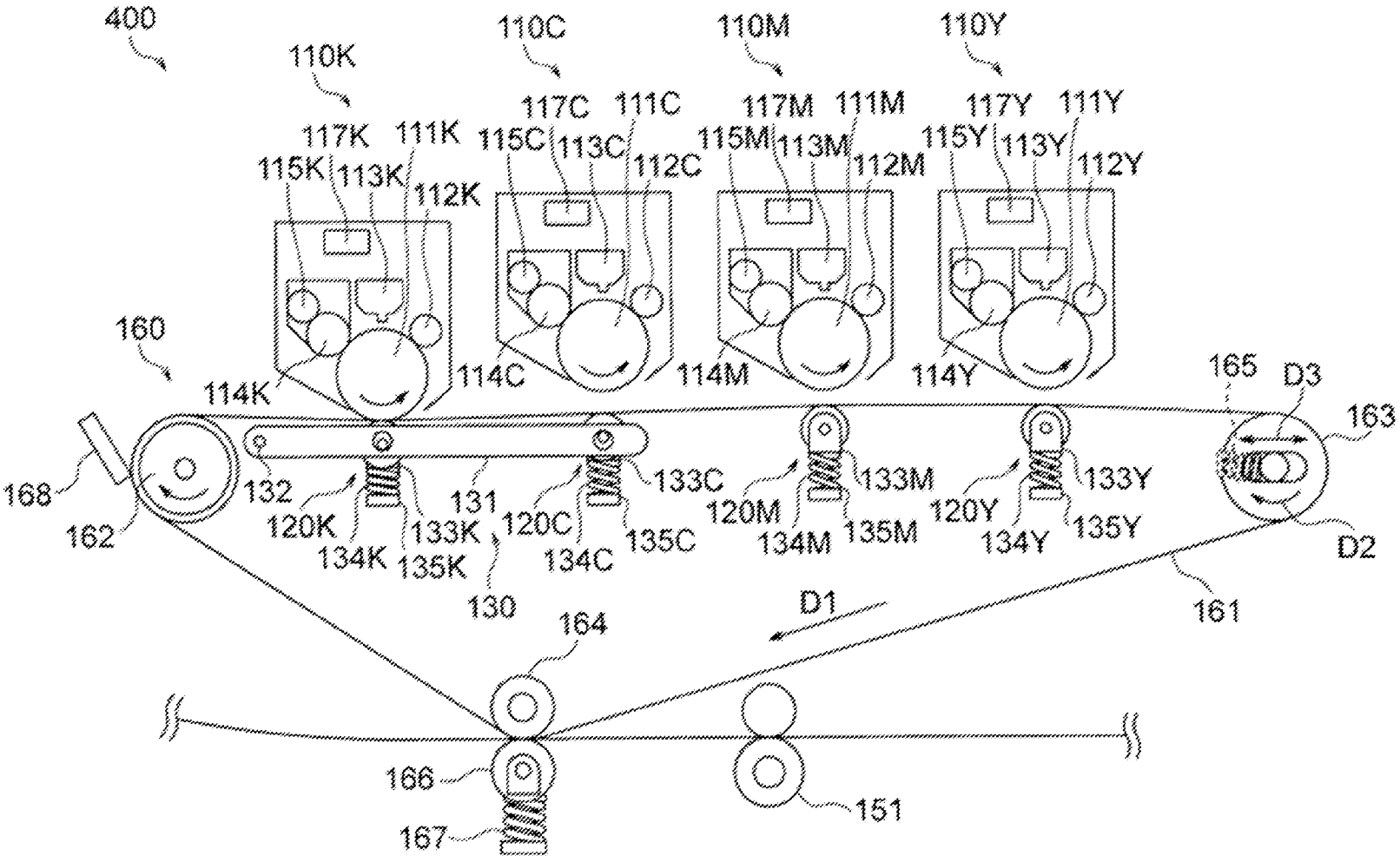
FIG. 15 is an enlarged cross-sectional view showing the main part of the image forming apparatus of the second modification.

Next, explained is an image forming apparatus 400 of a modification of the image forming apparatus 100 of Embodiment 1 and the image forming apparatus 200 of Embodiment 2. FIG. 15 is an enlarged cross-sectional view of the main part of the image forming apparatus 400 of the second modification.

The image forming apparatus 400 is an intermediate transfer type color tandem electrophotographic device, which is different from the image forming apparatus 100 of Embodiment 1 in the dispositions of the first image forming unit, the second image forming unit, the first transfer part, the second transfer part, and the pressing force variable mechanism, and is the same as the image forming apparatus 100 of Embodiment 1 in the other respects. Therefore, the components that are identical with or correspond to the components of the image forming apparatus 100 of Embodiment 1 are assigned the same codes as in the image forming apparatus 100 of Embodiment 1 and their explanations are omitted.

In the image forming apparatus 400, multiple image forming units are disposed in the order of an image forming unit 110K, an image forming unit 110C, an image forming unit 110M, and an image forming unit 110Y from the upstream side in the carrying direction of a transfer belt 161.

The image forming apparatus 400 has a second image forming unit disposed in the most upstream side of the carrying direction of the transfer belt 161. The first image forming unit is one of the image forming units disposed in the downstream side of the second image forming unit in the carrying direction of the transfer belt 161. For example, in the second modification, the first image forming unit is the image forming unit 110C, and the second image forming unit is the image forming unit 110K. In this case, the first transfer part is a primary transfer part 120C, and the second transfer part is a primary transfer part 120K. However, the first image forming unit and the second image forming unit are not limited by the colors or kinds of the stored developers.

According to the image forming apparatus 400 of the second modification, because of having the same efficacy as the image forming apparatus 100 explained in Embodiment 1, disturbances in a toner image transferred to the developer image carrier in the primary transfer position of the image forming unit 110K as the second image forming unit can be reduced. Also, according to the image forming apparatus 400 of the second modification, because of having the same efficacy as the image forming apparatus 200 explained in Embodiment 2, disturbances in a toner image transferred to the sheet P in the transfer position of the image forming unit 110K as the second image forming unit can be reduced.

The contents of the first modification and the second modification explained above can be mutually combined in an arbitrary manner and applied to the image forming apparatuses 100 and 200 explained in Embodiments 1 and 2.

In the embodiments and the modifications explained above, although explanations were given by regarding the image forming unit 110C as the first image forming unit and the image forming unit 110K as the second image forming unit, the first image forming unit and the second image forming unit are not limited by the colors or kinds of the stored developers. In the same manner, although explanations were given by regarding the primary transfer part 120C as the first transfer part and the primary transfer part 120K as the second transfer part, the first transfer part and the second transfer part are not limited by the colors of the transferred toner images. The number of image forming units is not limited to four but only needs to be two or more. The number of primary transfer rollers only needs to be two or more, which can be decided according to the number of image forming units.

The contents explained above can be applied to image forming apparatuses that utilize the electrophotographic system, such as copiers, facsimile machines, and printers.

What is claimed is:

1. An image forming apparatus, comprising:

a developer image carrier that rotates and carries developer images in a carrying direction, a first image forming unit and a second image forming unit that are disposed along the carrying direction of the developer image carrier, a first transfer part that is arranged sandwiching the developer image carrier with the first image forming unit to transfers a developer image formed in the first image forming unit to the developer image carrier, a first pressing force toward the developer image carrier being generated with the first image forming unit, a second transfer part that is arranged sandwiching the developer image carrier with the second image forming unit to transfers a developer image formed in the second image forming unit to the developer image carrier, a second pressing force toward the developer image carrier being generated with the second image forming unit, wherein one of the first image forming unit and the first transfer part moves away from the develop image carrier so that the one of the first image forming unit and the first transfer part has two different positions, one position being defined as an image forming position at which the first pressure force is generated therebetween and the developer image is transferred, the other position being defined as a non-image forming position at which no first pressing force is generated therebetween and the developer image is not transferred, the image forming apparatus further comprises a pressing force variable mechanism that increases the second pressing force between the second image forming unit and the second transfer part when the one of the first image forming unit and the first transfer part moves from the image forming position to the non-image forming position, and when the one of the first image forming unit and the first transfer part is at the non-image forming position that is a position separated from the developer image carrier, the pressing force variable mechanism causes the second pressing force between the second image forming unit and the second transfer part to be increased while moving another of the first image forming unit and the first transfer part in the direction to further stretch the developer image carrier.

2. The image forming apparatus according to claim 1, wherein the developer image carrier is in a circular shape, and the first image forming unit and the second image forming unit are both disposed outside the developer image carrier.

3. The image forming apparatus according to claim 1, wherein the pressing force variable mechanism further comprises:

a first bias part that biases the first transfer part toward the first image forming unit, and a second bias part that biases the second transfer part toward the second image forming unit.

4. The image forming apparatus according to claim 3, wherein the pressing force variable mechanism further comprises a link part that links the first transfer part and the second transfer part and adds an additional bias force to the second transfer part in the same direction as a first bias force by the first bias part is applied to the first transfer part.

5. The image forming apparatus according to claim 4, wherein the pressing force variable mechanism further comprises a fulcrum part that rotatably supports the link part.

6. The image forming apparatus according to claim 4, wherein the pressing force variable mechanism further comprises a cam that enhances the additional bias force that is added to the second transfer part through the link part in correspondence with a rotation of the cam.

7. The image forming apparatus according to claim 6, wherein the link part comprises a swing shaft provided between the first transfer part and the second transfer part in the carrying direction, the link part swinging around the swing shaft, and the cam is disposed to come into contact with the link part between the swing shaft and the second transfer part, swinging the link part around the swinging shaft in correspondence with a rotation of the cam so that the first transfer part is either in contact with or separated from the developer image carrier.

8. The image forming apparatus according to claim 1, wherein the second image forming unit is positioned in a downstream side of the first image forming unit in the carrying direction of the developer image carrier.

9. The image forming apparatus according to claim 1, further comprising:

a drive part that drives the developer image carrier, and a driven part that stretches the developer image carrier together with the drive part, wherein the second image forming unit is positioned between the driven part and the first image forming unit.

10. An image forming apparatus, comprising:

a carrying member that rotates and carries a medium thereon in a carrying direction, a first image forming unit and a second image forming unit that are disposed along the carrying direction of the carrying member, a first transfer part that is arranged sandwiching the carrying member with the first image forming unit to transfers a developer image formed in the first image forming unit to the carrying member, a first pressing force toward the carrying member being generated with the first image forming unit, a second transfer part that is arranged sandwiching the carrying member with the second image forming unit to transfers a developer image formed in the second image forming unit to the carrying member, a second pressing force toward the carrying member being generated with the second image forming unit, wherein one of the first image forming unit and the first transfer part moves away from the carrying member so that the one of the first image forming unit and the first transfer part have two different positions, one position being defined as an image forming position at which the first pressure force is generated therebetween and the developer image is transferred, the other position being defined as a non-image forming position at which no first pressing force is generated therebetween and the developer image is not transferred, and the image forming apparatus further comprises a pressing force variable mechanism that increases the second pressing force between the second image forming unit and the second transfer part when the one of the first image forming unit and the first transfer part moves from the image forming position to the non-image forming position, and when the one of the first image forming unit and the first transfer part is at the non-image forming position that is a position separated from the developer image carrier, the pressing force variable mechanism causes the second pressing force between the second image forming unit and the second transfer part to be increased while moving another of the first image forming unit and the first transfer part in the direction to further stretch the developer image carrier.

11. The image forming apparatus according to claim 10, wherein the first image forming unit and the second image forming unit are both disposed at the same side of the carrying member.

12. The image forming apparatus according to claim 10, wherein the pressing force variable mechanism further comprises:

a first bias part that biases the first transfer part toward the first image forming unit, and a second bias part that biases the second transfer part toward the second image forming unit.

13. The image forming apparatus according to claim 12, wherein the pressing force variable mechanism further comprises a link part that links the first transfer part and the second transfer part and adds an additional bias force to the second transfer part in the same direction as a first bias force by the first bias part is applied to the first transfer part.

14. The image forming apparatus according to claim 13, wherein the pressing force variable mechanism further comprises a fulcrum part that rotatably supports the link part.

15. The image forming apparatus according to claim 13, wherein the pressing force variable mechanism further comprises a cam that enhances the additional bias force that is added to the second transfer part through the link part in correspondence with a rotation of the cam.

16. The image forming apparatus according to claim 15, wherein the link part comprises a swing shaft provided between the first transfer part and the second transfer part in the carrying direction, the link part swinging around the swing shaft, and the cam is disposed to come into contact with the link part between the swing shaft and the second transfer part.

17. The image forming apparatus according to claim 10, wherein the second image forming unit is positioned in an upstream side of the first image forming unit in the carrying direction of the carrying member.

18. The image forming apparatus according to claim 10, further comprising:

a drive part that drives the carrying member, and a driven part that stretches the carrying member together with the drive part, wherein the second image forming unit is positioned between the driven part and the first image forming unit.

* * * * *